US010861426B2

(12) United States Patent
Renzi

(10) Patent No.: US 10,861,426 B2
(45) Date of Patent: Dec. 8, 2020

(54) REPLACEMENT HEEL PEDESTAL DEVICE AND SYSTEM

(71) Applicant: John Elvan Renzi, Riverside, CA (US)

(72) Inventor: John Elvan Renzi, Riverside, CA (US)

( * ) Notice: Subject to any disclaimer, the term of this patent is extended or adjusted under 35 U.S.C. 154(b) by 0 days.

(21) Appl. No.: 16/792,075

(22) Filed: Feb. 14, 2020

(65) Prior Publication Data

US 2020/0211516 A1 Jul. 2, 2020

Related U.S. Application Data

(63) Continuation-in-part of application No. 16/351,163, filed on Mar. 12, 2019, now Pat. No. 10,607,582, which is a continuation-in-part of application No. 15/742,642, filed as application No. PCT/US2016/046201 on Aug. 9, 2016, now abandoned, which is a continuation of application No. 14/822,531, filed on Aug. 10, 2015, now abandoned.

(60) Provisional application No. 62/321,018, filed on Apr. 11, 2016, provisional application No. 62/290,820, filed on Feb. 3, 2016.

(51) Int. Cl.
*G10D 13/11* (2020.01)

(52) U.S. Cl.
CPC ..... *G10D 13/11* (2020.02)

(58) Field of Classification Search
CPC ..... G10D 13/11
See application file for complete search history.

(56) References Cited

U.S. PATENT DOCUMENTS 3,426,640 A * 2/1969 Slingerland, Jr. ..... G10D 13/11 84/422.1
5,565,637 A * 10/1996 Shigenaga ..... G10D 13/11 84/422.1
6,359,205 B1 * 3/2002 Lombardi ..... G10D 13/11 84/422.1
6,590,147 B2 * 7/2003 Kassabian ..... G10D 13/11 84/422.1
6,684,734 B2 * 2/2004 Gatzen ..... G10D 13/065 74/560
6,992,244 B2 * 1/2006 Paul ..... G10D 13/11 84/422.1
7,297,852 B1 * 11/2007 Chen ..... G10D 13/11 84/422.1
7,897,858 B1 * 3/2011 Liao ..... G10D 13/11 84/422.1
8,212,133 B2 * 7/2012 Chen ..... G10D 13/11 84/422.1
8,278,541 B2 * 10/2012 Dorfman ..... G10D 13/11 84/422.1

(Continued)

FOREIGN PATENT DOCUMENTS

WO WO-2017027522 A1 * 2/2017 ..... G10D 13/065

*Primary Examiner* — Robert W Horn
(74) *Attorney, Agent, or Firm* — Hankin Patent Law, APC; Kevin Schraven; Anooj Patel

(57) ABSTRACT

An illuminated replacement heel pedestal system comprising: a top plate, which comprises one or more lights, a wiring harness, a top portion, a bottom portion, and a screw receiving plate that is substantially contained between the bottom portion and the top portion. The top plate is configured to replace an original equipment heel plate. The lights may be connected to a power source, which when turned on, powers the lights and illuminates the top plate.

20 Claims, 26 Drawing Sheets

(56) References Cited

U.S. PATENT DOCUMENTS

| | | | | |
|---|---|---|---|---|
| 8,455,746 | B2 * | 6/2013 | Johnston | G10D 13/11<br>84/422.1 |
| 8,669,454 | B1 * | 3/2014 | Lin | G10D 13/00<br>84/422.1 |
| 8,735,705 | B1 * | 5/2014 | Chen | G10D 13/11<br>84/422.1 |
| 8,859,870 | B2 * | 10/2014 | Yamane | G10H 1/348<br>84/422.1 |
| 8,927,844 | B2 * | 1/2015 | Kitching | G10D 13/11<br>84/422.1 |
| 9,460,692 | B2 * | 10/2016 | Chen | G10D 13/11 |
| 9,472,174 | B2 * | 10/2016 | Sikra | G10D 13/11 |
| 9,640,154 | B2 * | 5/2017 | Sikra | G10D 13/11 |
| D842,373 | S * | 3/2019 | Renzi | D17/22 |
| 10,607,582 | B2 * | 3/2020 | Renzi | G10D 13/11 |

* cited by examiner

REPLACEMENT HEEL PEDESTAL DEVICE AND SYSTEM

CROSS-REFERENCE TO RELATED APPLICATIONS

This Application is a Continuation in Part Application of U.S. Non-Provisional patent application Ser. No. 16/351,163, filed on Mar. 12, 2019, now U.S. patent Ser. No. 10,607,582, which is a Continuation in Part Application of U.S. Non-Provisional patent application Ser. No. 15/742,642, filed on Jan. 8, 2018. U.S. Non-Provisional patent application Ser. No. 15/742,642, filed on Apr. 13, 2018, is a U.S. National Stage PCT Application of PCT Application No. PCT/US2016/046201, filed on Aug. 9, 2016. The PCT Application No. PCT/US2016/046201 claims the benefit of (1) U.S. Non-Provisional patent application Ser. No. 14/822,531, filed on Aug. 10, 2015, titled "Replacement Drum Pedal Heel Pedestal", by sole inventor John Elvan Renzi, (2) U.S. Provisional Patent Application No. 62/290,820, filed on Feb. 3, 2016, titled "Replacement Drum Pedal Heel Pedestal", by sole inventor John Elvan Renzi, and (3) U.S. Provisional Patent Application No. 62/321,018, filed on Apr. 11, 2016, titled "Replacement Drum Pedal Heel Pedestal With LED Lights", by sole inventor John Elvan Renzi, the contents of which all six parent Applications are expressly incorporated herein by this reference as though set forth in their entirety.

FIELD

The present disclosure relates generally to an illuminated replacement drum foot pedal apparatus, and more specifically, to a drum foot-pedal heel pedestal or replacement heel pedestal system that is comfortable, illuminated, and may easily connect to existing drum foot pedals.

SUMMARY

To minimize the limitations in the cited references, and to minimize other limitations that will become apparent upon reading and understanding the present specification, the present specification discloses a new and improved illuminated replacement heel pedestal top plate and pedestal system.

Preferably, the replacement heel pedestal top plate and pedestal system may be transparent or translucent, in order to allow any type of lighted system to illuminate the replacement heel pedestal. These lighted systems may comprise, are not limited to: incandescent lamps; compact fluorescent lamps; halogen lamps; metal halide lamps; light emitting diode (LED); liquid crystal displays (LCD); fluorescent tube; neon lamps; high intensity discharge lamps; low pressure sodium lamps; and/or chemical lights. The illuminated replacement heel pedestal system preferably has the same form, fit, and function as the device and system disclosed and claimed in U.S. patent application Ser. No. 16/351,163, the contents of which are hereby incorporated by this reference.

In some embodiments, the illumination may be provided by a chemiluminescent substance, which does not require a power source or power supply. But, most embodiments, preferably, may use a power source or a power supply to provide power to the illumination device and system.

The term power supply or power source, as used herein, may refer to an electrical device used to give electrical supply to electrical loads. The main function of this device is to change the electrical current from a source to the accurate voltage, frequency and current to supply the electrical load required to activate the illumination device and system. Sometimes, these power supplies may be referred to as electric power converters. In various embodiments the power supply may be integrated into the replacement heel pedestal, or it may be outside of the replacement heel pedestal and connected to the illumination device and system by an electrical cord or wire.

The device and system of the present disclosure may use a power supply circuit. The power supply circuits may be classified into different types based on the power they utilize for providing power to circuits or devices. For example, microcontroller-based circuits may generally be a 5 Volt (V) direct current (DC) regulated power supply (RPS) circuit, which can be designed with the help of different methods for changing the power from 230V alternating current (AC) to 5V DC. In one embodiment, the power supply circuit may convert 230V AC to 12V DC through the following steps: a step-down transformer may convert the 230V AC into 12 v; a bridge rectifier may be used to change AC to DC; a capacitor may be used to filter the AC ripples and pass the electrical charge to the voltage regulator; the voltage regulator regulates the voltage to 5V; and a blocking diode may be used for blocking the flow of the current from reversing direction and discharging the pulsating waveform or power source.

In various embodiment, different types of power supplies may be use, including, but not limited to one or more of the following: switched mode power supply (SMPS) (also called a computer power supply); an uninterruptable power supply; AC power supply; DC power supply; regulated power supply (RPS); programable power supply; computer power supply; and linear power supply. An SMPS or a computer power supply, is one type of power supply that usually includes a switching regulator for converting electrical power in a powerfully manner. Like other power supplies, the SMPS transmits the power from a DC source or an AC source to DC loads, such as a PC (personal computer), while converting voltage and current characteristics. The power supply unit in a computer may be the part of the hardware that is used for changing the power supplied from the outlet into utilizable power for the various parts of the computer. It converts the AC into DC. It may also control over-heating through controlling voltage, which may be modified, manually or automatically, based on how the power supply is used. The power supply unit (PSU) is also referred to as a power converter or a power pack. In a computer, the internal components like cases, motherboards, and power supplies may generally be available in different configurations and sizes to conform with what is needed. As is well known in the art, these components must be well-matched to work appropriately together.

An uninterruptible power supply (UPS) is an electrical device that permits an electrically powered device, such as a personal computer (PC) to keep working for some time as the main power supply is lost. It may also give protection from power spikes and power flow. A UPS may include a battery to store an amount of power/energy, such that when there is a loss of power from the main source (AC wall outlet), power may continue to flow to the PC so that the user may shut down in a controlled manner.

Typically, an AC power supply may be supplied to a facility via a step up or step-down transformer to the required voltage for an electrical outlet. The different types of AC power supplies are designed to offer a stable, constant current. In some cases, as the AC power supply may come from a DC supply that goes through a step-up transformer and an inverter. In some embodiments, the AC power alteration does not use a transformer. If the input and output voltages are similar, then the main function of the device power supply is to filter the raw incoming AC power.

A DC power supply is one that provides a consistent DC voltage to its load. Based on its configuration, a DC power supply might be controlled from a DC supply or from a converted AC supply. An example of a DC power supply is a battery.

A redundant power supply (RPS) may be used when a single piece of computer equipment operates using two or more physical power supplies. Each power supply may have the capacity to run the device or system on its own; allowing for continuous operations even if one of the original power supplies fail. A programmable power supply may permit remote control for its operation. The properties of a programmable power supply that may be controlled may include current, voltage, and/or frequency. Programmable power supplies may be used with a wide range of applications, such as the fabrication of semiconductors, X-ray generators, monitoring of crystal growth, and automated apparatus testing.

A linear power supply (LPS) or linear regulator (LR) circuit may be used in supplying the DC current needed to the entire circuit. The linear power supply typically includes a step-down transformer, rectifier, filter circuit, and voltage regulator. The main function of the LPS is that it may first step down the alternating current voltage then change it into direct current. Other features of LPS may include: an efficiency that ranges from 20 to 25%; that the magnetic materials used in the LPS may be cold-rolled grain-oriented steel or similar alloy; it is more reliable, less complex, and less bulky; a faster response; low noise level; and it is less expensive.

One or more of the above types of power supplies, or other similar types of power supplies may all be used to provide electrical power to the illuminated replacement heel pedestal device and system.

Currently, some drum manufacturers use LED light systems on and inside the drum shells. Typically, drummers have the option of selecting the light colors through an electronical control module. The device and system of the present disclosure may be configured to operate in conjunction with, or separate from, the original equipment manufacturer drum kit light controller.

In some embodiments, the device and system of the present disclosure may comprise a wiring harness, one or more LED lights, plug ends, and one or more A/C adapter plugs. When the illuminated advanced heel pedestal system is installed the user will have a fully modular, adjustable, and comfortable replacement heel pedestal system that will be able to illuminate before, during and/or after playing the instrument. The lighting system of the present may provide the drummer or percussionist a way to place and operate their drum pedals when playing on stage in low light or no light conditions. This has been an issue with drummers and percussionists for years and has typically been addressed by the use of fluorescent tape to be placed next to their foot pedals to ensure correct foot pedal placement when playing.

One embodiment may be a replacement heel pedestal system comprising: a top plate; wherein the top plate comprises a one or more lights and a wiring harness; wherein the wiring harness is configured to connect the one or more lights to a power source, such that when the power source is turned on the one or more lights are illuminated; wherein the top plate is configured to replace an original equipment heel plate and wherein the top plate has a width that is wider than a width of the original equipment heel pedestal. The top plate may further comprise: a front that is wider than a rear; a top portion; a bottom portion; a screw receiving plate that is substantially contained between the bottom portion and the top portion; a top surface; a slot opening; a recessed portion; and one or more tongue pilot holes. Preferably, at least the top surface and the top portion of the top plate may be transparent. The slot opening may be a female notch on the front of the top plate that may be configured to allow the top plate to couple with a tongue of a foot pedal, such that the top plate and the foot pedal are hingedly coupled together. The recessed portion may be on the bottom and the front of the top plate. The screw receiving plate may comprise one or more receiver nuts that may be aligned with at least the one or more tongue pilot holes and may be configured to allow one or more fasteners to couple the top plate to the tongue of the foot pedal. The top portion of the top plate may comprise two tapered side wings that extend beyond a width of the bottom portion of the top plate and that taper inward from the front to the rear. The top plate may further comprise one or more base plate pilot holes. The recessed portion of the top plate may be configured to engage with at least a top of a base plate of the foot pedal. The one or more receiver nuts may be further aligned with the one or more base plate pilot holes and may be configured to allow the one or more fasteners to couple the top plate to the base plate of the foot pedal. The top surface of the top plate may be textured, such that a user's foot is substantially prevented from slipping off the top plate. The system may further comprise a first elevation plate; wherein the first elevation plate may be configured to be matingly coupled between the top plate and the base plate of the foot pedal. The system may further comprise a first elevation plate; wherein the first elevation plate may be configured to be matingly coupled between the top plate and the base plate of the foot pedal; wherein the first elevation plate may comprise: an elevated portion on a front of the first elevation plate, which may comprise one or more tongue holes; two cut tapered side wings; a base portion; one or more base plate holes; and a recessed portion. The first elevation plate may be configured to be coupled between the top plate and the base plate of the foot pedal. The elevated portion may be configured to matingly engage with the slot opening of the top plate. The one or more tongue holes of the first elevation plate may be aligned with the one or more tongue pilot holes of the top plate; and wherein the one or more base plate holes of the first elevation plate may be aligned with the one or more base plate pilot holes of the top plate. The two cut tapered side wings preferably stop short of the front of the first elevation plate and taper inward towards a rear of the first elevation plate. The system may further comprise at least one second elevation plate. The at least one second elevation plate may be configured to be matingly coupled between the top plate and the base plate of the foot pedal. The at least one second elevation plate may comprise: one or more tongue holes; two tapered side wings; a base portion; one or more base plate holes; and a recessed portion. The one or more tongue holes of the second elevation plate may be aligned with the one or more tongue pilot holes of the top plate and the one or more tongue holes of the first elevation plate; and wherein the one or more base plate holes of the second elevation plate may be aligned with the one or more base plate pilot holes of the top plate and the one or more base plate holes of the first elevation plate. The two tapered side wings of the second elevation plate may extend to the front of the second elevation plate and taper inward towards a rear of the second elevation plate. The system may further comprise a slot plug, which comprises a peg and one or more tongue holes; and wherein the top plate further comprises a peg slot that may be configured to matingly couple with the peg of the slot plug. In some embodiments the power source is a battery that is engaged with the top plate. The wiring harness may comprise an adapter that is configured to electrically connect the wiring harness to a power source.

In one embodiment the heel pedestals may be constructed from organic and/or inorganic rubbers, such as silicone, FKM or fluoroelastomers, EPDM (ethylene propylene diene terpolymer (an extremely durable synthetic polymer)), Butyl, Polyisoprene, and Nitrile rubber. In one embodiment, the plates may be made from styrene-butadiene or styrene-butadiene rubber (SBR) materials to create the specific Shore A and Shore D Durometer compounds necessary for the present system. These materials have excellent abrasion resistance and good aging stability.

In one embodiment, the top plate may be manufactured in three parts. The elevation plates may each be molded as separate single parts. The top plate may comprise a steel screw receiver insert plate. The screw receiver plate eliminates the issue of over torqueing the screws when attaching the top plate. The screw receiver plate may be placed between co-molded top portion and bottom portion. The top plate top and bottom portions may be constructed from an SBR Shore A-50 Durometer, which is a hardness scale in Durometers. The top plate portions may be constructed from SBR Shore A in the Durometer range of 10 to 100 Durometers, but preferably 50. The plates and other pedestal system parts may be manufactured with an SBR Shore D compound in the range of 10 to 75 Durometers. This material, combined with the broad width and depth of the pedestal system, may provide a new level of comfort or feel to the drummer or percussionist, as if they were wearing a high-end running shoe. This may provide a higher level of comfort, balance, stability, endurance, and play sustainability to the drummer. Essentially, the system of the present disclosure may allow the user to recover more quickly from the exhausting task of foot pedal drumming. The material may also be extremely durable and resist breaking down under consistent loads and pressures. The raised honeycomb grip pattern may further extend the life span of the top plate and allow for even wearing.

One embodiment may be a method for replacing an original heel plate with a heel pedestal system that is more ergonomically designed and engineered to fit the drummer and percussionist lower-body and feet position, regardless of playing in a seated or standing position, with an, adjustable, comfortable, versatile, and illuminated heel pedestal system without causing damage to the original heel plate or foot-pedal system.

One embodiment may be a modular heel pedestal system that does not require substantial changes to existing drum foot pedals. The modular and adjustable heel pedestal device and system disclosed herein may raise and lower the heel height of the drummer and/or percussionist in order to achieve a desired angularity for ease of foot actuation of the pedal. Preferably, the device and system of the present disclosure may increase a drummer's balance, stability, and comfort which may directly correlate to longer and more sustainable play while reducing player fatigue, which may reduce injuries and support correct foot and lower body drum pedal positioning while establishing individual player ergonomic pedaling and playing techniques.

Other features and advantages will become apparent to those skilled in the art from the following detailed description and its accompanying drawings.

BRIEF DESCRIPTION OF THE DRAWINGS

The drawings show illustrative embodiments, but do not depict all embodiments. Other embodiments may be used in addition to or instead of the illustrative embodiments. Details that may be apparent or unnecessary may be omitted for the purpose of saving space or for more effective illustrations. Some embodiments may be practiced with additional components or steps and/or without some or all components or steps provided in the illustrations. When different drawings contain the same numeral, that numeral refers to the same or similar components or steps.

DETAILED DESCRIPTION OF THE EMBODIMENTS

Figure 1:
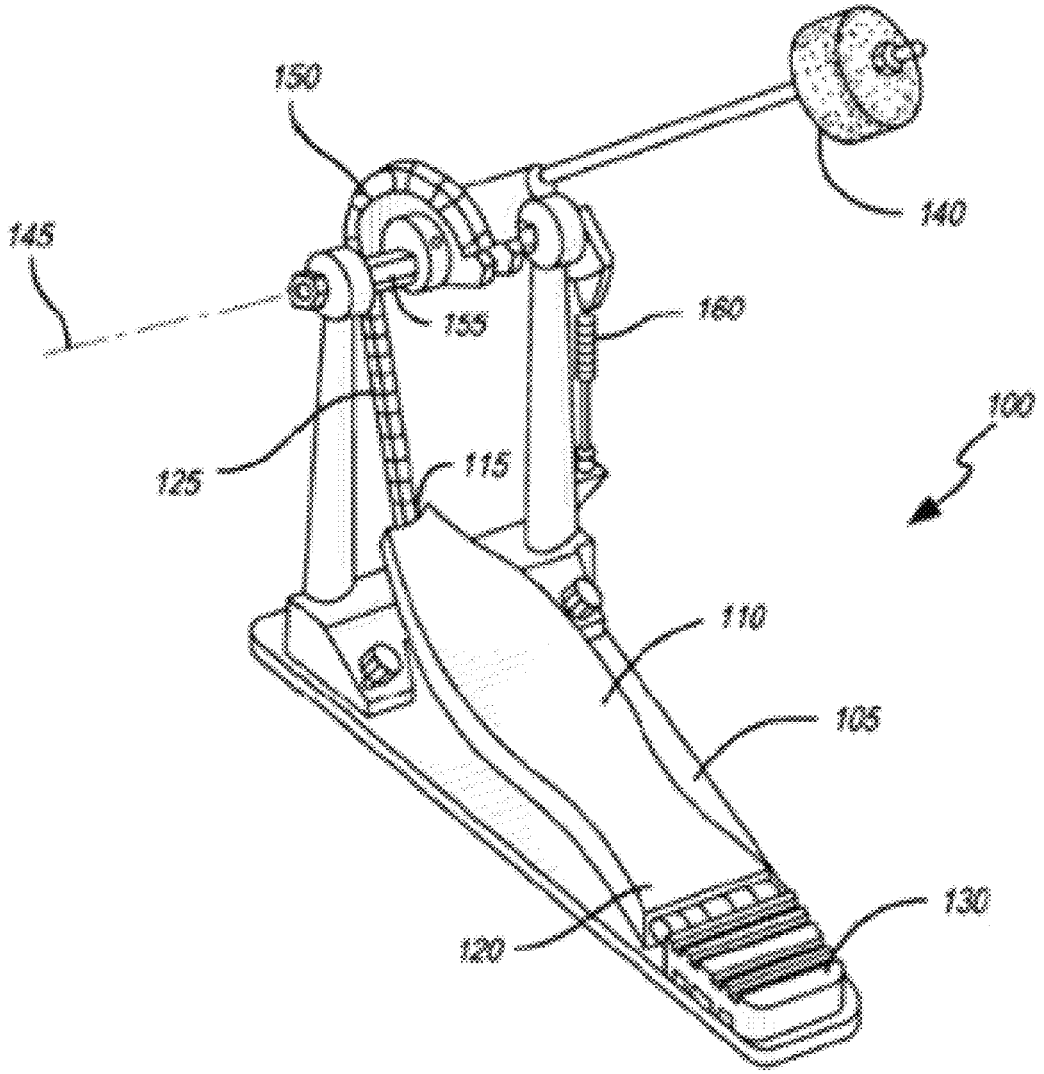
[PRIOR ART] FIG. 1
FIG. 1 is an illustration of a perspective view of a drum foot pedal of the prior art.

In the following detailed description of various embodiments, numerous specific details are set forth in order to provide a thorough understanding of various aspects of the embodiments. However, the embodiments may be practiced without some or all of these specific details. In other instances, well-known procedures and/or components have not been described in detail so as not to unnecessarily obscure aspects of the embodiments.

While some embodiments are disclosed here, other embodiments will become obvious to those skilled in the art as a result of the following detailed description. These embodiments are capable of modifications of various obvious aspects, all without departing from the spirit and scope of protection. The Figures, and their detailed descriptions are to be regarded as illustrative and not restrictive. Also, the reference or non-reference to a particular embodiment shall not be interpreted to limit the scope of protection.

In the following description, certain terminology is used to describe certain features of one or more embodiments. For purposes of the specification, unless otherwise specified, the term "substantially" refers to the complete or nearly complete extent or degree of an action, characteristic, property, state, structure, item, or result. For example, in one embodiment, an object that is "substantially" located within a housing would mean that the object is either completely within a housing or nearly completely within a housing. The exact allowable degree of deviation from absolute completeness may in some cases depend on the specific context. However, generally speaking, the nearness of completion will be so as to have the same overall result as if absolute and total completion were obtained. The use of "substantially" is also equally applicable when used in a negative connotation to refer to the complete or near complete lack of an action, characteristic, property, state, structure, item, or result.

As used herein, the terms "approximately" and "about" generally refer to a deviance of within 5% of the indicated number or range of numbers. In one embodiment, the term "approximately" and "about", may refer to a deviance of between 0.0001-10% from the indicated number or range of numbers.

As used herein, the term "foot pedal" refers to a drum, high-hat, or other type of percussion instrument foot pedal that engages the foot of a user in order to play the percussion instrument. The "foot pedal" may be a drum foot pedal, a high-hat foot pedal, or any drum/percussion hardware, which requires a foot pedal system to play. Typically, the foot pedal may comprise a heel plate, a foot pedal plate (sometimes referred to as just a foot pedal), a base plate or base frame, a hinge component, which may have one or more tongues, a linkage, a drive system, and a beater.

As used herein the term "base plate" refers to a bottom support structure that is generally underneath the foot pedal plate. The base plate may be a plate, wire frame, or other similar structure that provides support to the system.

As used herein the term "transparent" refers to being transparent, substantially transparent, translucent, and/or substantially translucent. The transparent top plate generally allows light to pass through so that objects behind can be seen, sometimes distinctly. The purpose of having a transparent top plate is to allow lights contained within the top plate to shine through and illuminate the top plate and area surrounding the top plate.

FIG. 1 is an illustration of a perspective view of a foot pedal of the prior art (drum, high-hat, or other). The drum foot pedal 100 is a foot-operated lever used to control various mechanisms to play or modify the sounds of a musical instrument such as a drum or pair of high-hat cymbals. As shown in FIG. 1, a drum foot pedal 100 generally comprises a base plate 105; a foot pedal plate 110 having a toe end 115 and a heel end 120. The toe end 115 may be connected to a linkage 125, such as a chain, and the heel end 120 may be fastened to an original heel plate 130 via a tongue. A drum beater 140, such as a mallet, may be actuated about a horizontal axis 145, in response to downward pressure on the toe end 115 of the pedal 110. For example, in response to downward pressure on the pedal 110, the linkage 125 actuated by a rotor 150 and axle 155 may cause the drum beater 140 to rotate about an axis. A return spring 160 may be incorporated to provide resistance, thereby allowing the drum beater 140 to move to its original position. This will help the user to utilize the drum beater 140 again. Preferably, the heel plate 130 is removable and may be replaced with the heel pedestal system of the present disclosure.

Figure 2:
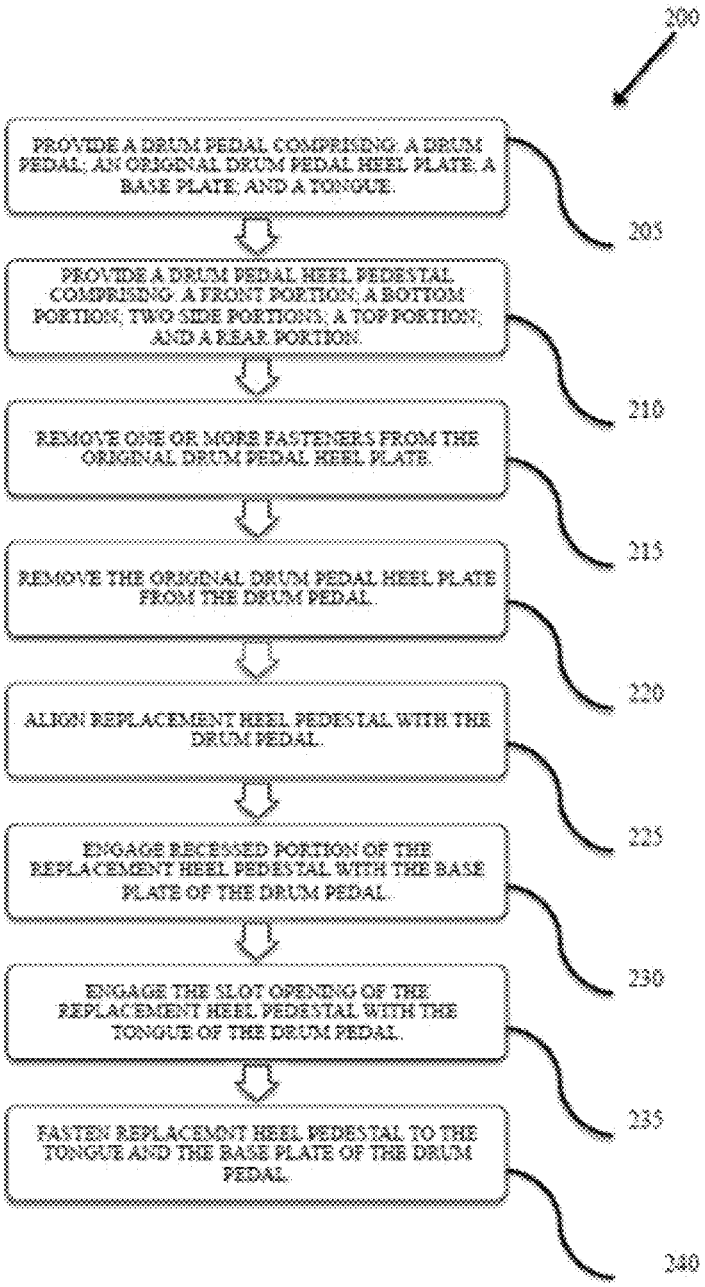
FIG. 2 is a flow block diagram of one embodiment of a method of replacing an original drum foot pedal heel plate with a replacement heel pedestal top plate.

FIG. 2 is a flow block diagram of one embodiment of a method of replacing an original drum foot pedal heel plate with a replacement heel pedestal top plate. As shown in FIG. 2, one embodiment of the method 200 may comprise steps 205, 210, 215, 220, 225, 230, 235, and 240. FIG. 2 shows that the first step 205 is preferably to provide a drum foot pedal. As discussed above, a drum foot pedal 100 is generally a foot-operated lever used to control various mechanisms to play or modify the sounds of a musical instrument. Preferably, the drum foot pedal comprises a drum foot pedal, with an original heel plate, a base plate, and a tongue. The original heel plate may be coupled to the base plate and the tongue via fasteners. The drum foot pedal may also comprise other components such as a linkage (e.g., chain), drum beater, (e.g., mallet), and return spring.

FIG. 2 also shows the second step 210, which may be to provide a drum foot pedal heel pedestal, also referred to as a replacement heel pedestal device and/or system. Preferably, the replacement heel pedestal top plate comprises a front portion, a bottom portion, two side portions, a top portion, and a rear portion. The front portion may comprise a slot opening, which is generally an opening used to receive the tongue of a drum foot pedal. The bottom portion may comprise a recessed portion. The two side portions may comprise a left side portion and a right side portion. The recessed portion is preferably between the left side portion and the right side portion, and may extend from the left side portion to the right side portion. The left side portion and the right side portion should preferably comprise an overhanging top section and a narrower bottom section, creating two tapered side wings. The recessed portion may be configured to matingly engage with the base plate of a drum foot pedal. The drum foot pedal heel pedestal system may be manufactured from any material including, but not limited to, plastic, polymer, resin, thixo, urethane, metal injection molding, liquid silicone rubber, wood, coated wood, laminated wood, particle board, composite wood, and/or compressed resin wood. Preferably, the parts and plates are primarily constructed from styrene-butadiene rubber (SBR) Shore A-50 and Shore D-50.

Next, the third step 215 of the method 200 may be to remove the fasteners from the original drum foot pedal heel plate. The fasteners may include base plate fasteners and tongue fasteners. These fasteners may be removed in various ways. For example, in various embodiments, the fasteners may be removed by unscrewing, heating, and the like. In another embodiment, a heat source may be applied in order to loosen the fasteners from the base plate fastener holes and the tongue fastener holes of the drum foot pedal. Once the fasteners are removed, the user may remove the original drum foot pedal heel plate from the drum foot pedal, as shown in the fourth step 220.

The method may also comprise the fifth step 225, which may be to align the replacement heel pedestal top plate and/or system with the drum foot pedal. Specifically, when the replacement heel pedestal system is engaged with the drum foot pedal, the tongue fastener holes on the base plate may align with the tongue fastener holes of the tongue and the tongue pilot holes of the replacement heel pedestal system. This may occur when the tongue of the drum foot pedal is fully inserted into the slot opening of the replacement heel pedestal. Similarly, the base plate fastener holes may align with one or more base plate pilot holes of the replacement heel pedestal when the replacement heel pedestal engages with the base plate. The user may then engage the recessed portion of the replacement heel pedestal with the base plate of the drum foot pedal, as shown in the sixth step 230. Similarly, the user may also engage the slot opening of the replacement heel pedestal with the tongue of the drum foot pedal, as shown in the seventh step 235.

Finally, the method 200 may comprise the eighth step 240, which may be to fasten the replacement heel pedestal top plate or system to the tongue and the base plate of the drum foot pedal. The user may utilize various fasteners, including, without limitation screws; self-tapping screws; bolts; nails; adhesives; welds; solder; ultrasonic welds; pins, keys; pegs; hook and loop; staples; buttons; zippers; anchors; rivets; grommets; latches; clasps; and clips. In the event that the replacement heel pedestal is constructed from material that is engageable with self-tapping screws, the pilot holes are not as necessary.

Figure 3:
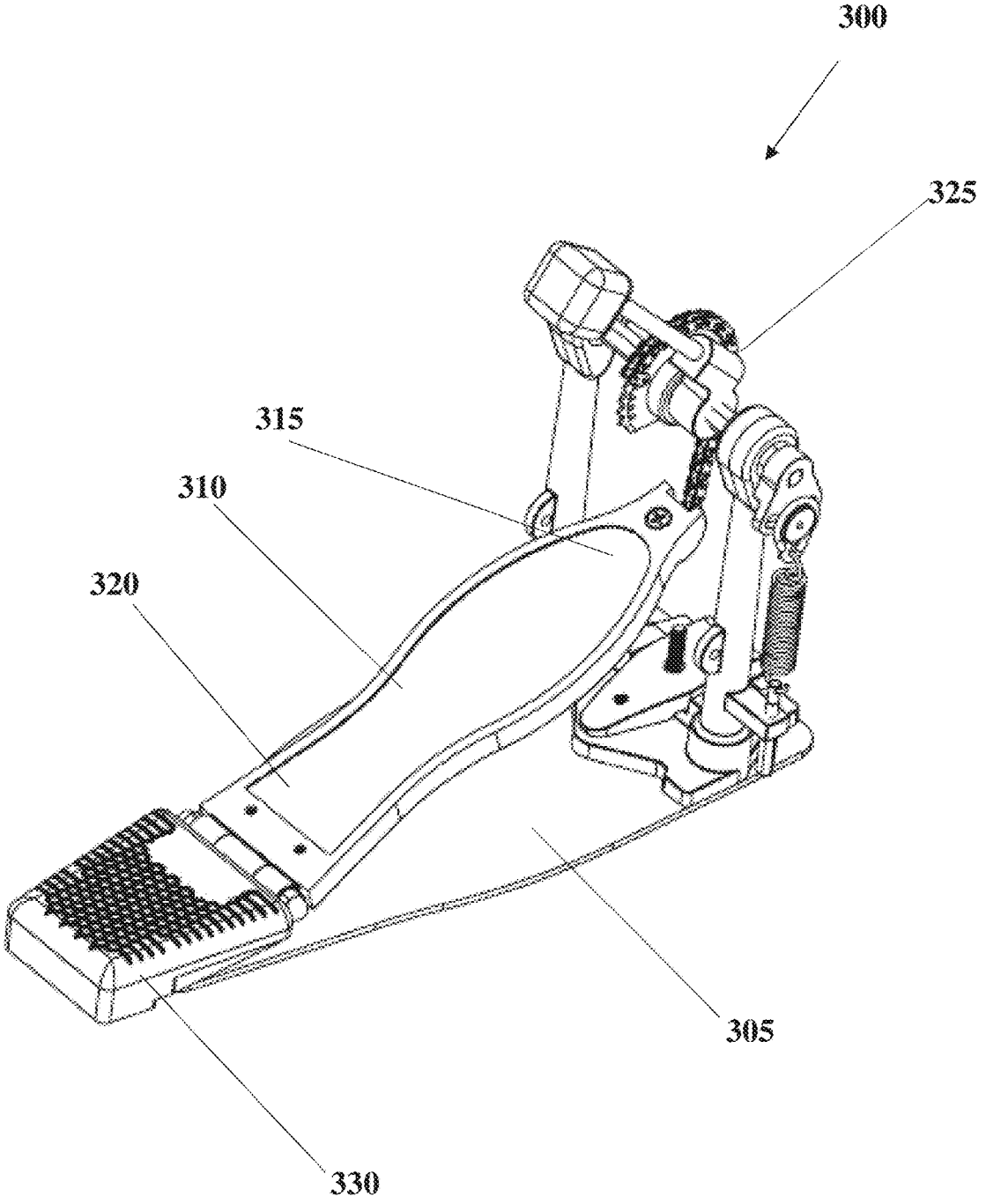
FIG. 3 is an illustration of a perspective view of one embodiment of a replacement heel pedestal top plate attached to a drum foot pedal and base plate.

FIG. 3 is an illustration of a perspective view of one embodiment of a replacement heel pedestal top plate attached to a drum foot pedal and base plate. As shown in FIG. 3, the drum foot pedal 300 may comprise a base plate 305; a pedal 310 (also called a foot pedal plate or foot plate) having a toe end 315 and a heel end 320. The toe end 315 may be coupled to a linkage 325, such as a chain, and the heel end 320 may be fastened to a replacement heel pedestal top plate 330 via a tongue. The tongue may be fastened to the replacement heel pedestal top plate 330 via one or more fasteners. The base plate 305 may be a plate or a frame and may have various holes and/or connection mechanisms or fasteners to attach to the tongue and a heel plate (shown in FIG. 1) or replacement heel pedestal top plate 330. The tongue may also comprise one or more tongue fastener holes, which may cover and align with the tongue fastener holes in the base plate 305. Specifically, the tongue fastener holes on the base plate 305 are preferably configured to align with the tongue fastener holes of the tongue and the tongue pilot holes of the replacement heel pedestal top plate 330 when the tongue of the pedal 310 is inserted into the slot opening of the replacement heel pedestal top plate 330. Similarly, the base plate fastener holes may align with one or more base plate pilot holes of the replacement heel pedestal top plate 330 when the replacement heel pedestal top plate 330 engages with the base plate 305. The replacement heel pedestal top plate 330 may also fasten to the base plate 305 of the drum foot pedal 300 via fasteners.

In one embodiment, the tongue of the pedal 310 may not matingly fit into the slot opening of the replacement heel pedestal top plate 330. Accordingly, the tongue of the pedal 310 may need to be unfastened from the heel end 320 of the pedal 310 and rotated approximately 180 degrees. Rotation of the tongue approximately 180 degrees may provide the correct configuration of the tongue such that the tongue may fit into the slot opening of the replacement heel pedestal top plate 330. The tongue is essentially a dual plate hinge that connects the replacement heel pedestal 330 to the foot pedal 310. The replacement pedestal 330 is designed to engage with one or more original equipment manufacturer foot pedals.

Figure 4:
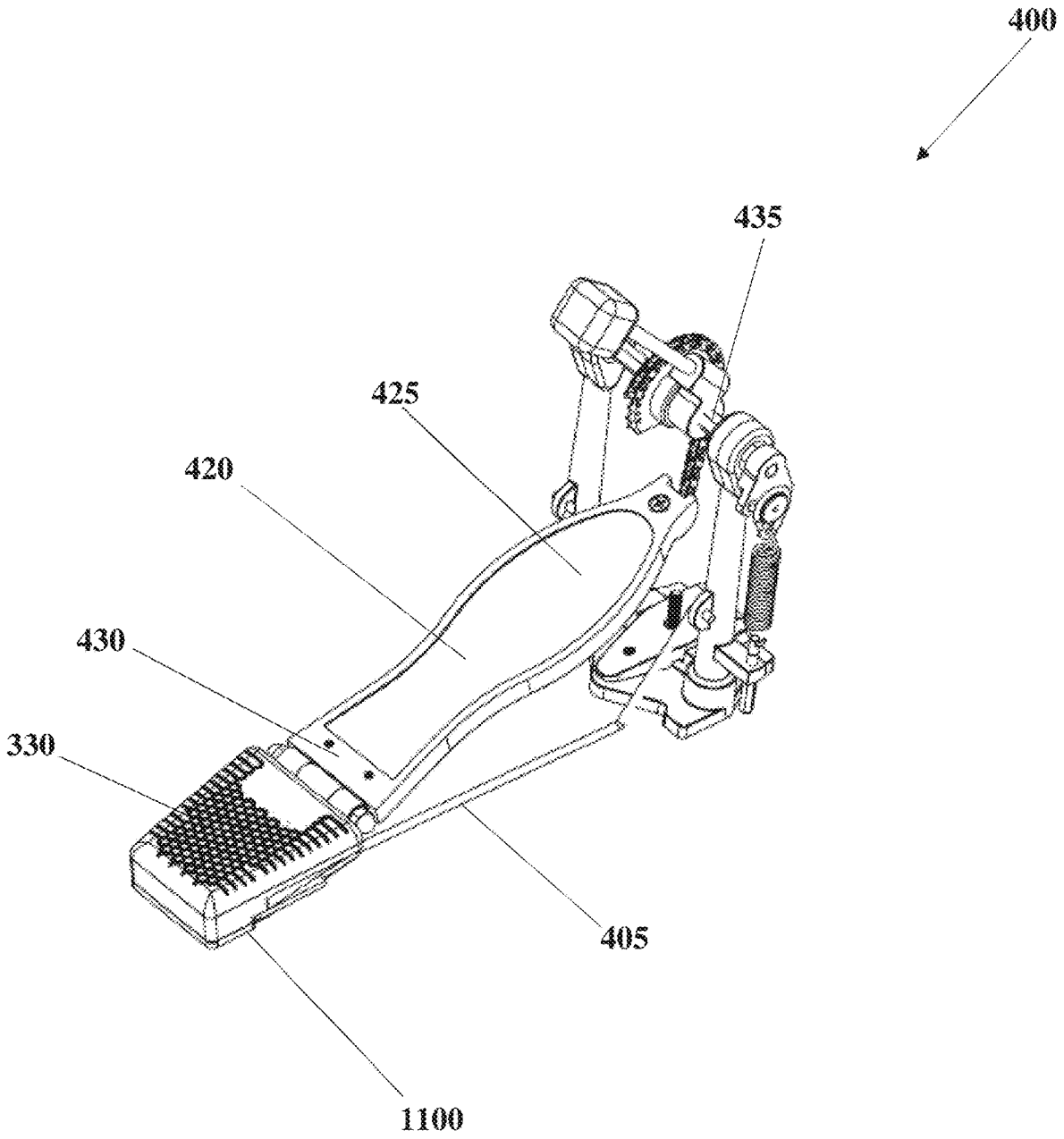
FIG. 4 is an illustration of a perspective view of one embodiment of a replacement heel pedestal system attached to a drum foot pedal and base frame.

FIG. 4 is an illustration of a perspective view of one embodiment of a replacement heel pedestal system attached to a drum foot pedal and base frame. The drum foot pedal 400 may comprise a base frame 405 instead of a base plate (as shown in FIG. 3). The base frame 405 may comprise a left frame and a right frame that run along the sides of the foot pedal 400. The base frame 405 may provide structural support for the foot pedal. The pedal 420 may comprise a toe end 425 and a heel end 430. The toe end 425 may be connected to a linkage 435, such as a chain, and the heel end 430 may be fastened to a replacement heel pedestal system 350 via a tongue. The tongue may be fastened to the replacement heel pedestal system 350 via one or more fasteners. The tongue may comprise one or more tongue fastener holes, which are preferably configured to align with the tongue pilot holes of the replacement heel pedestal system 350 when the tongue of the pedal 420 is inserted into and/or overlaid onto the slot opening of the replacement heel pedestal system, which, as shown in FIG. 4, may comprise a top plate 330 and a first elevation plate 1100.

Figure 5:
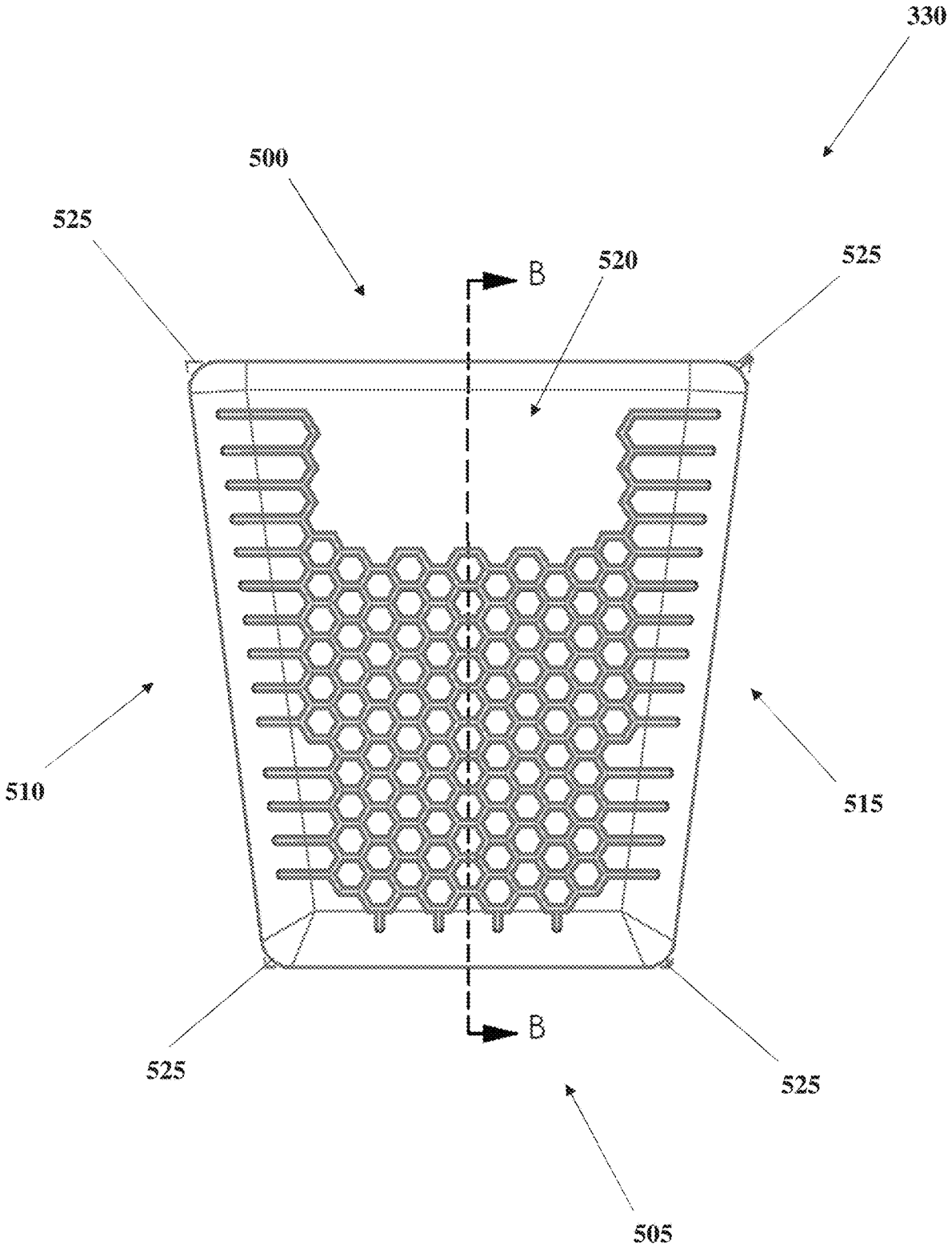
FIG. 5 is an illustration of a top view of one embodiment of a replacement heel pedestal top plate.

FIG. 5 is an illustration of a top view of one embodiment of a replacement heel pedestal top plate. As shown in FIG. 5, one embodiment of the replacement heel pedestal top plate 330 may comprise: a front 500, rear 505, two sides 510, 515, top surface 520, and a bottom surface. The top surface 520 of the replacement heel pedestal top plate 330 may be textured. The texture may comprise various patterns, including, without limitation, a honeycomb pattern, in order to reduce heel slippage and reduce premature wear. The texture grip pattern may be part of the mold of the top portion of the top plate and may be constructed from SBR Shore A-50.

Additionally, FIG. 5 shows that the front 500 of the replacement heel pedestal top plate 330 may taper to the rear 505, such that the front portion 500 is wider than the rear portion 505. The top plate 330 is preferably longer and wider than the original heel plate that it is replacing. As shown, the corners 525 of the replacement heel pedestal top plate 330 may also be curved or rounded, in order to provide additional comfort to the user.

The replacement pedestal top plate 330 preferably has a larger top surface area than the heel plate that it is replacing. It may be both wider and longer. The grip pattern and larger surface area combine to provide increased foot stability correlating to increased player performance and sustainability (endurance). The replacement pedestal top plate 330 is preferably SBR Shore A-50 that provides a firm and durable area for the foot and heel and replaces the standard harsh steel or metal fabricated heel pad. The softer replacement pedestal top plate 330 may absorb the shock of the foot during pedaling. It may also provide a comfortable and larger area for resting, finessing, or stomping, and/or when using various types of pedaling techniques or playing styles, such as the "heel down," "heel up," or "heel-toe" techniques. This shock absorbing replacement pedestal top plate 330 may absorb significant loads, which directly correlates to reducing overall foot and body stress. The replacement pedestal top plate 330 may be made into a single piece but is preferably made from three portions. One portion of the top plate may be a metal screw receiver insert plate. The screw receiver plate eliminates the issue of over torqueing the screws when attaching the top plate to the tongue or base plate. The screw receiver plate may be placed between a co-molded top portion and bottom portion. The top and bottom portions may be constructed from an SBR Shore A-50, which is a hardness scale in Durometers.

Figure 6:
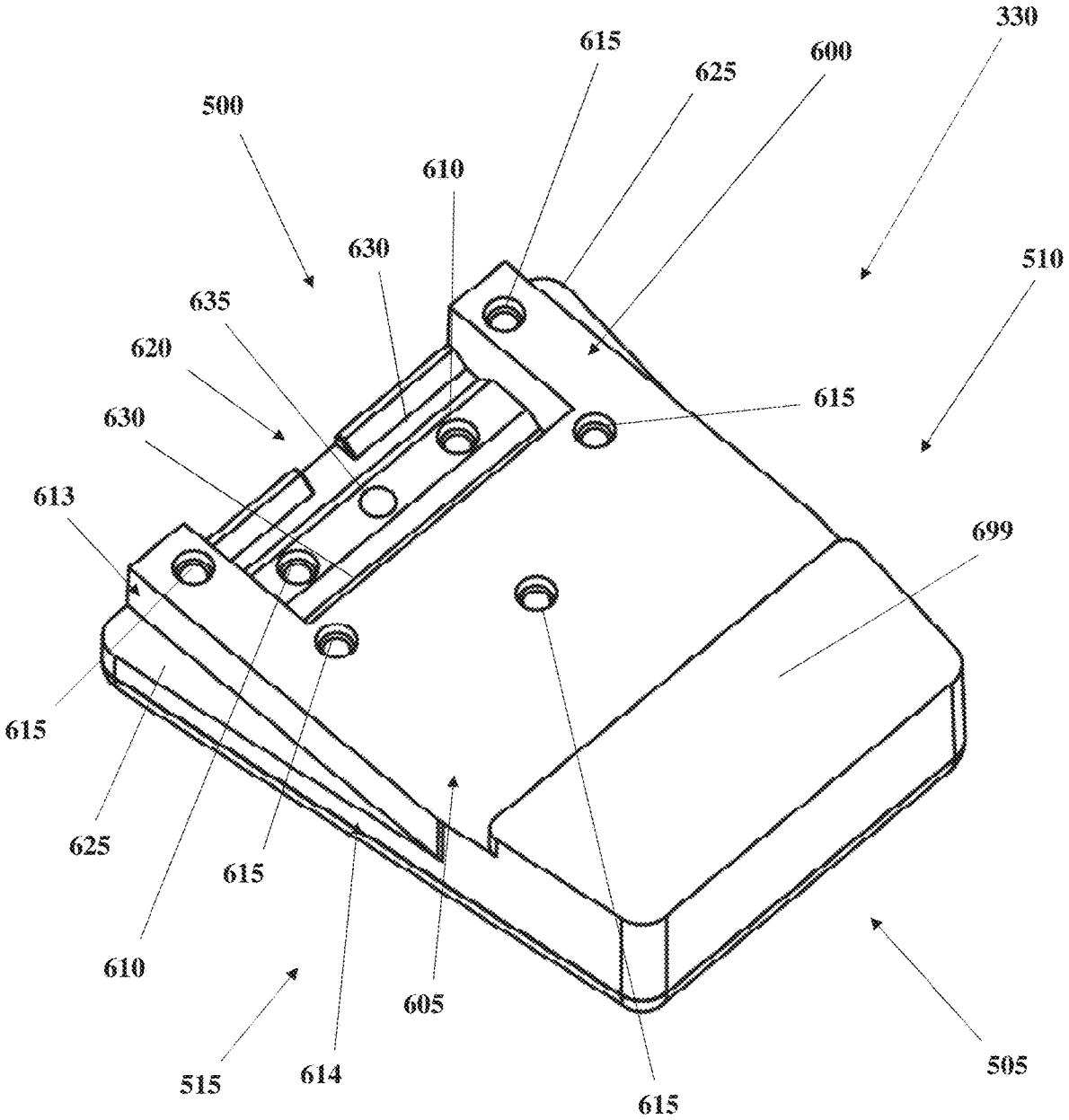
FIG. 6 is an illustration of a bottom perspective view of one embodiment of a replacement heel pedestal top plate.

FIG. 6 is an illustration of a bottom perspective view of one embodiment of a replacement heel pedestal top plate. FIG. 6 shows that the bottom portion 600 of the replacement heel pedestal top plate 330 may comprise a recessed portion 605 and base portion 699. The recessed portion 605 is preferably between the left side portion 510 and the right side portion 515 and may extend from the left side portion 510 to the right side portion 515. The recessed portion 605 may be rounded or otherwise configured to matingly engage with a base plate of a drum foot pedal at a proximal section of the recessed portion 605. The replacement heel pedestal top plate 330 may be tapered inwardly from the front 500 to the rear 505, such that the front 500 may be wider than the rear 505. In this manner, the replacement heel pedestal top plate 330 may better engage with the base plate.

The replacement heel pedestal top plate 330 may comprise one or more pilot holes 610, 615, which may be pedal frame fastener pilot holes, tongue pilot holes 610, and/or base plate pilot holes 615. The pilot holes are generally positioned at the bottom surface 600 of the replacement heel pedestal top plate 330. The tongue pilot holes 610 may generally be configured to align with the tongue fastener holes of the tongue when the tongue of the drum foot pedal is inserted into the slot opening 620. The base plate pilot holes 615 may be configured to align with the base plate fastener holes when the bottom portion 600 of the replacement heel pedestal top plate 330 mates or engages with the base plate of the drum foot pedal. Additionally, the replacement heel pedestal top plate 330 may be fastened to the tongue and/or base plate of the drum foot pedal via one or more fasteners. The fasteners may be any connection mechanism, device, or method, including, without limitation screws; self-tapping screws; bolts; nails; adhesives; welds; solder; ultrasonic welds; pins, keys; pegs; hook and loop; staples; buttons; zippers; anchors; rivets; grommets; latches; clasps; and clips. In the event that the drum pedal heel pedestal 330 is constructed from a material that is engageable with self-tapping screws, the pilot holes 610, 615 are not as necessary.

The pilot holes 610, 615 may be positioned in various locations on the bottom surface 600 of the replacement heel pedestal top plate 330, depending upon the location of the holes on the tongue and base plate of the drum foot pedal. In this manner, the replacement heel pedestal top plate 330 is versatile and may be used with various types and brands of drum foot pedals.

FIG. 6 shows that the top plate 330 may comprise a top portion 614 and a bottom portion 613. The top portion 614 may be made from a single mold around the screw receiver plate or two separate molds that are joined around the screw receiver plate. The top portion 614 may be made from an SBR Shore A-50. The bottom portion 613 may be made from an SBR Shore D-50.

FIG. 6 shows that the left side portion 510 and right side portion 515 of the top portion 614 of the top plate 330 may extend beyond the width of the recessed portion 605 of the bottom portion 613 of the top plate, thus creating two tapered side wings 625 from the front 500 to roughly the midpoint of the left side portion 510 and right side portion 515. The tapered side wings 625 may ensure that the recessed portion 605, and therefore the replacement heel pedestal 330, fit various types and brands of drum foot pedals while also providing further support. B is the cross-section line for the view shown in FIG. 8.

FIG. 6 also shows the slot opening 620, which is preferably configured to matingly engage the tongue or otherwise allow the engagement of the tongue by the replacement heel pedestal 330. The slot opening 620 may contain two grooves 630, which may be perpendicular to the front 500. The grooves 630 provide female indentations and may allow a wider variety of tongues to fit firmly within the slot opening 620. The slot opening 620 preferably contains a peg slot 635 wherein an additional removable slot plug (shown in FIG. 20) may be inserted, decreasing the overall depth of the slot opening 620 and covering the two grooves 630.

The pilot holes 610, 615, as shown, may have inset metal threads in order to matingly engage with a screw that is interconnecting the pedestal 330 to the tongue, base plate, or base frame.

The location and diameter of the pilot holes 610, 615 are preferably configured to align with one or more original equipment manufacturer drum foot pedals. Accordingly, several different embodiments of the pedestal may be provided in order to engage with various brands of drum foot pedals. In one embodiment the pedestal top plate 330 and elevation plates may be configured to engage with drum foot pedals made by Drum Workshop®, including series 3000, 5000, 6000, 7000, 9000, DW® Direct Drive™, and DW® Chain Drive™ (single and double bass pedal systems and percussion pedal systems). In another embodiment, the pedestal top plate 330 and elevation plates may be configured to engage with drum foot pedals made by Pearl®, including, but not limited to Eliminator Series: Powershifter P-2000C/P2002C, Eliminator Readline P2050C/P2050BL, P2052CL/P2052BL. In another embodiment, the pedestal top plate 330 and elevation plates may be configured to engage with drum foot pedals made by Tama®, including the Cobra Series: Iron Cobra® 600, HP600DTW, HP200PTW, Cobra 900 Rolling Glide Single and Double Bass, Iron Cobra® 900 Power Glide Single, TAMHP900PSWN Coil Spring, PH900PSN Power Glide, HP900FSW Flexi Glide, TAMHP900RSWN Rolling Glide Twin Bass Pedal. One or more embodiments of the pedestal top plate 330 and elevation plates may be configured to engage with Canopus™ brand drums foot pedals. One or more embodiments of the pedestal top plate 330 and elevation plates may be configured to engage with other base drum foot pedals, percussion foot pedals, and/or high-hat foot pedals of all brands or manufacturers who manufacture drum hardware comprising a foot pedal or foot pedal system.

To the extent that one or more of the pilot holes 615, 610 are not used, a plug, threaded or otherwise may be inserted into the holes 610, 615 to prevent dirt from accumulating.

Figure 7:
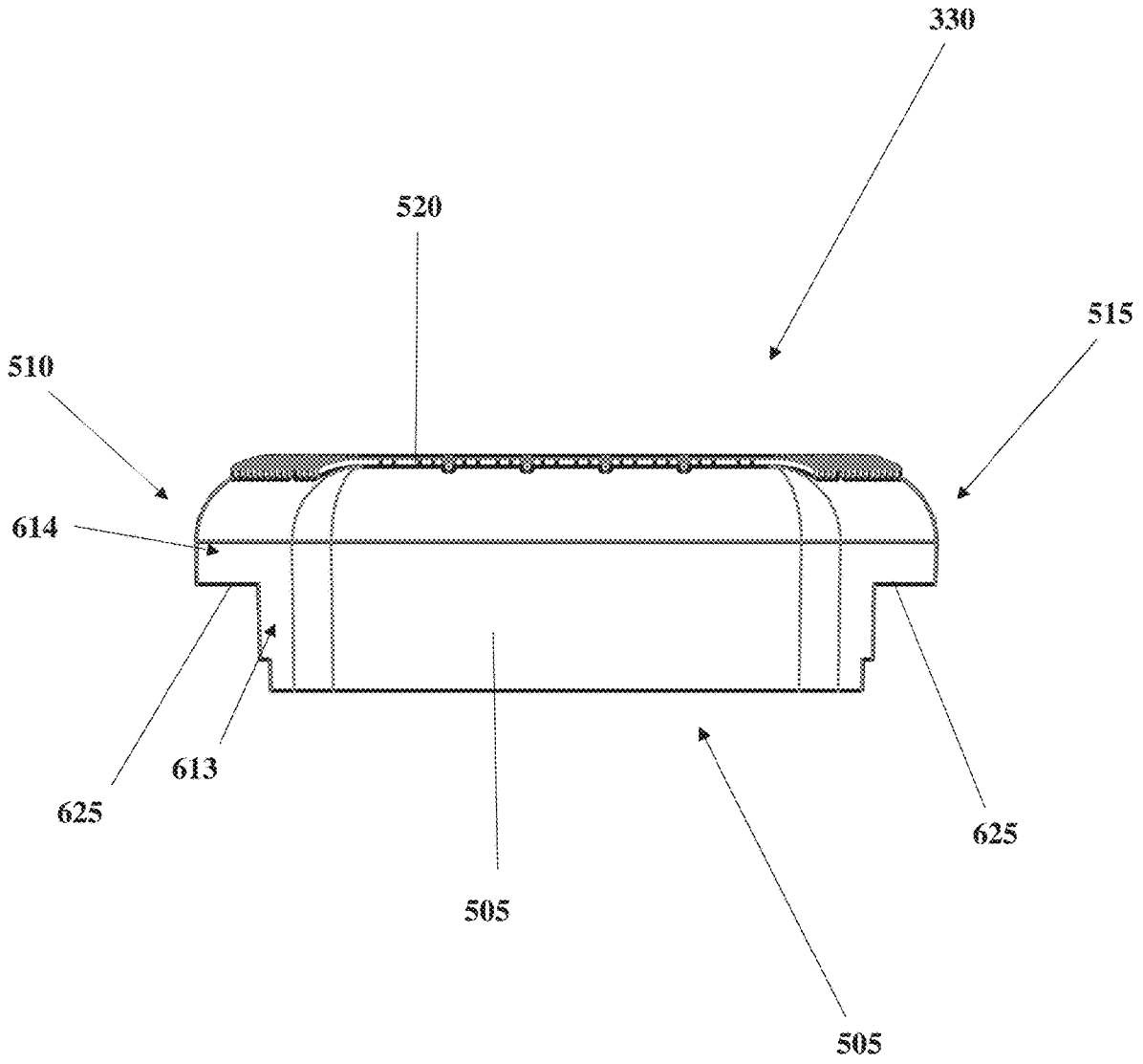
FIG. 7 is an illustration of a rear view of one embodiment of a replacement heel pedestal top plate.

FIG. 7 is an illustration of a rear view of one embodiment of a replacement heel pedestal top plate. As shown in FIG. 7, one embodiment of the replacement heel pedestal top plate 330 may comprise a top portion 614, bottom portion 613, rear 505 and, two sides 510, 515. The two sides 510, 515 may comprise tapered side wings 625, which generally rest upon a base plate. The two side portions 510, 515 may comprise a left side portion 510 and a right side portion 515.

The tapered side wings 625 may be on a planar surface and may be substantially parallel with the top surface 520 of the replacement heel pedestal top plate 330. In one embodiment, the tapered side wings 625 may rest on a raised lip of the base plate, providing superior support to the replacement heel pedestal system.

Figure 8:
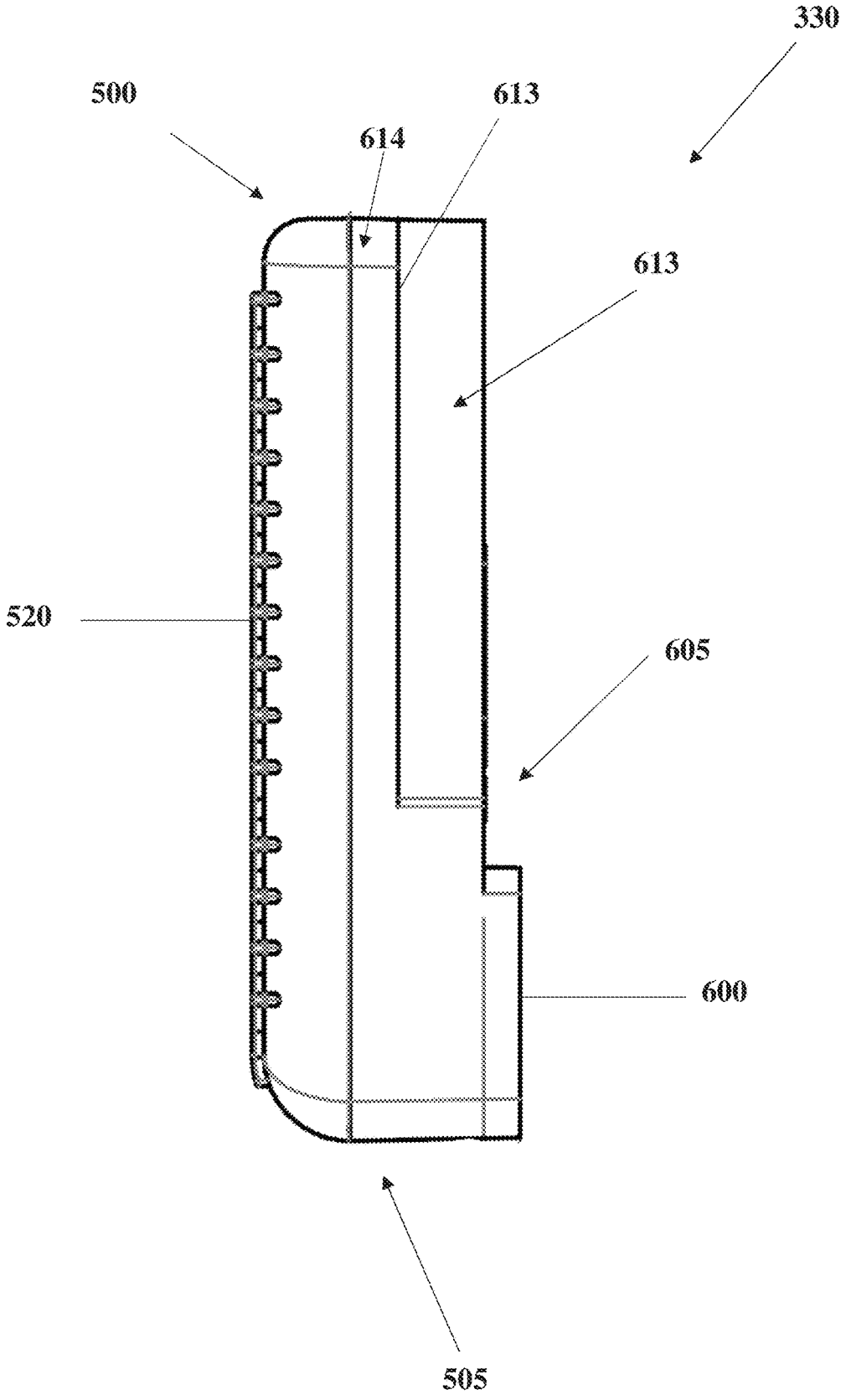
FIG. 8 is an illustration of a side view of one embodiment of a replacement heel pedestal top plate.

FIG. 8 is an illustration of a side view of one embodiment of a replacement heel pedestal top plate. As shown in FIG. 8, one embodiment of the replacement heel pedestal top plate 330 may comprise a top portion 614, a bottom portion 613, a front 500, a rear 505, a bottom surface 600, and a top surface 520. The recessed portion 605 may be substantially parallel to the top surface 520 and the bottom surface 600. The tapered side wings 625 may also be substantially parallel to the top surface 520 and the bottom surface 600.

Figure 9:
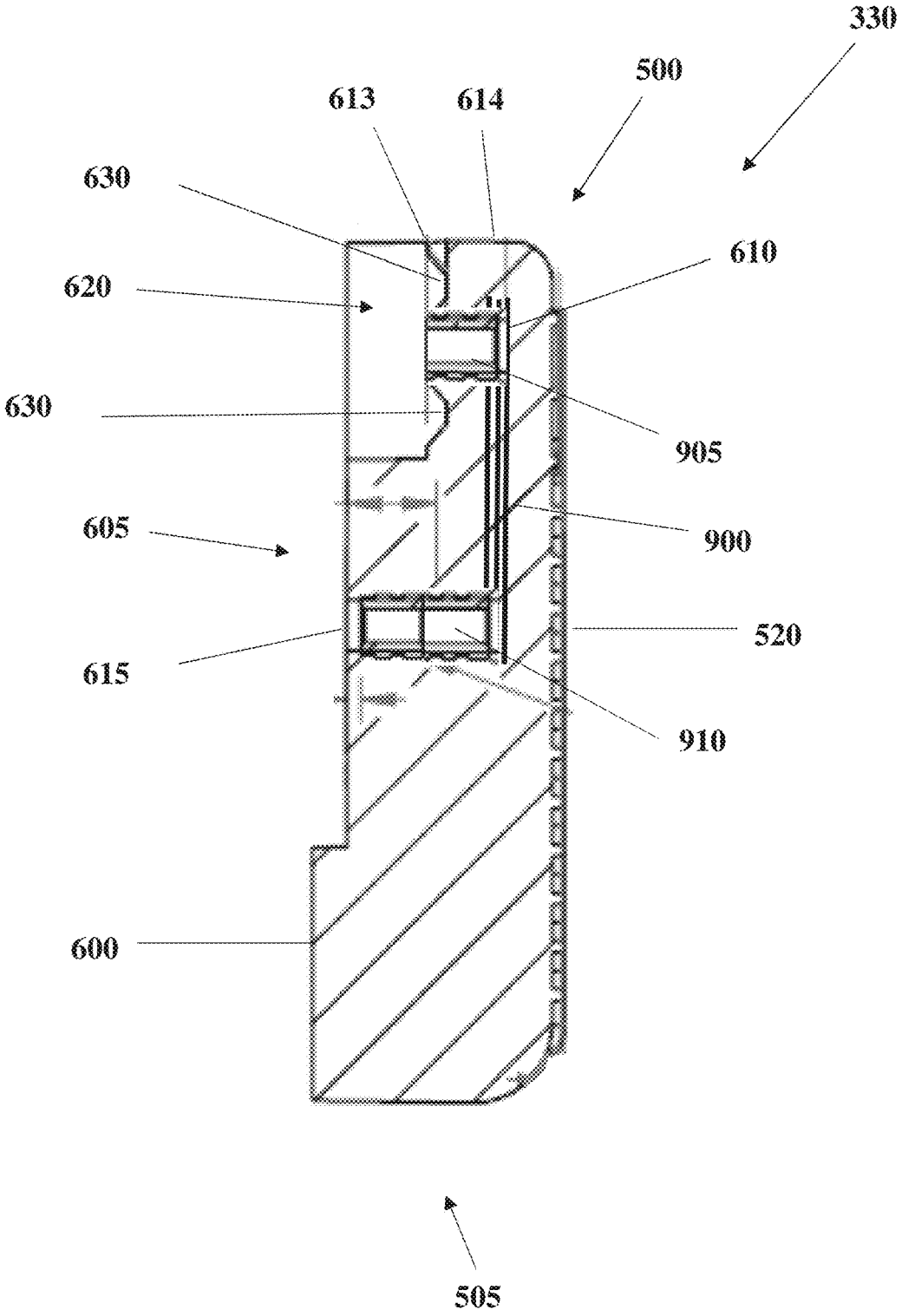
FIG. 9 is an illustration of a cross-section view of one embodiment of a replacement heel pedestal top plate.

FIG. 9 is an illustration of a cross-section view of one embodiment of a replacement heel pedestal top plate. As shown in FIG. 9, one embodiment of the top plate may have a top portion 614, a bottom portion 613, a front 500 a rear 505, a bottom surface 600, and a top surface 520. The slot opening 620 may have two parallel grooves 630 that permit the tongue of some foot pedals to fit matingly within. FIG. 9 also shows that the top plate 330 may comprise a screw receiving plate 900. The pilot holes 610, 615 may guide the fasteners into a metal screw receiving plate 900, which may be fitted with a plurality of short receiver nuts 905 and long receiver nuts 910. The combination of the receiver nuts 905, 910 and the metal plate 900 provide a reinforced screw receiving portion. When, unnecessarily, using a power drill to attach a screw or fastener through the pilot holes 610, 615, the receiver nuts 905, 910 may prevent the screw from stripping away the material of the pedestal top plate 330. The plate 900 fixes the receiver nuts 905, 910 in place and prevents them from moving through the material of the pedestal top plate 330 by spreading out the force on one nut throughout the screw receiving plate 900.

Figure 10:
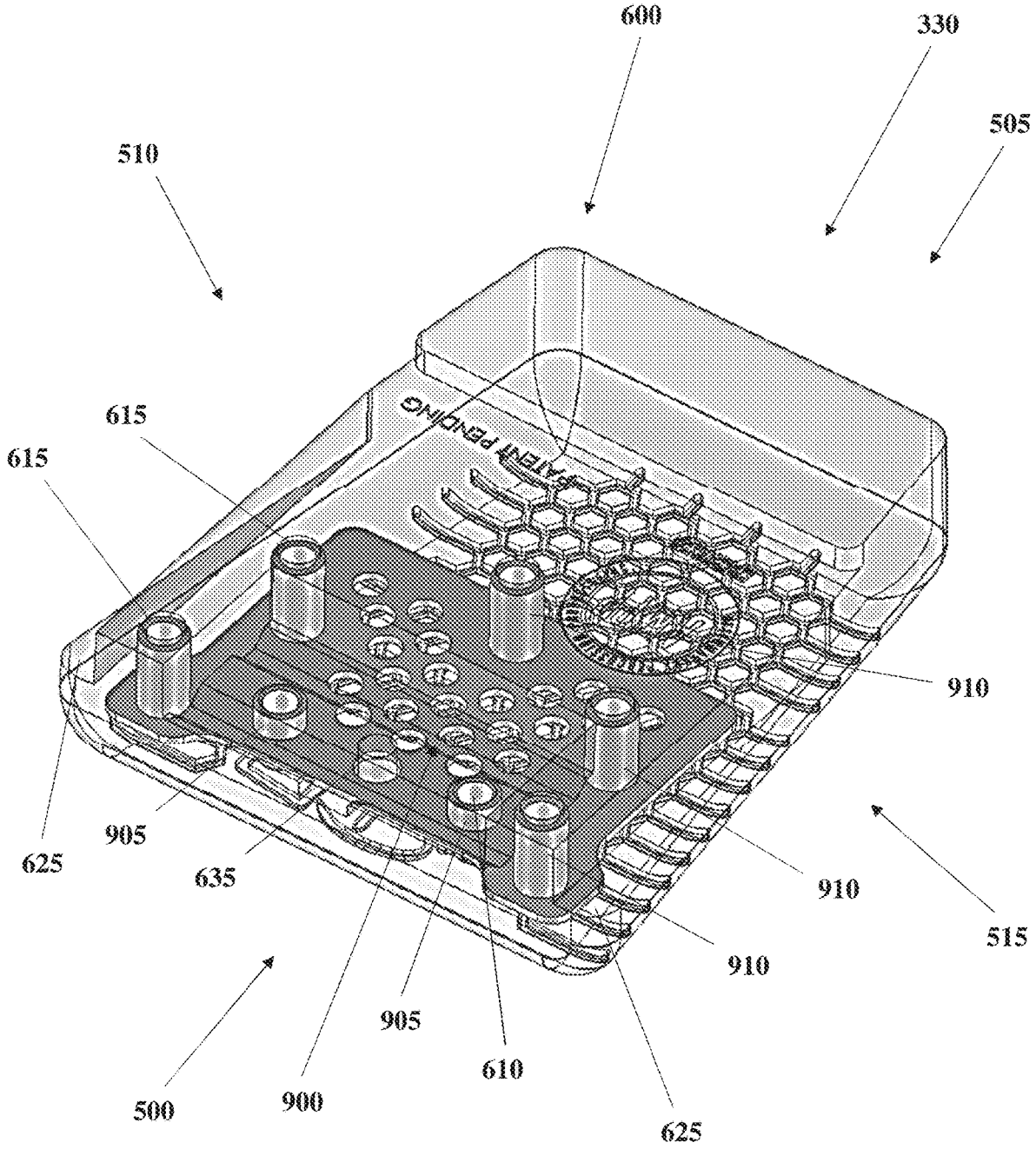
FIG. 10 is an illustration of a transparent bottom perspective view of one embodiment of a replacement heel pedestal plate.

FIG. 10 is an illustration of a transparent bottom perspective view of one embodiment of a replacement heel pedestal plate. FIG. 10 shows that the bottom surface 600 has a plurality of pilot holes 610, 615 that matingly enclose receiver nuts 905, 910. The receiver nuts 905, 910 may be unitary with, or affixed, to a screw receiving plate 900, which may be situated between the left top portion 614 and the bottom portion 613. The screw receiving plate 900 may preferably be situated in the front portion 500 of the top plate 330, and the sides should extend toward the tapered side wings 625 in the front section. The front side 500 of the metal plate 900 may contain a peg slot 635 allowing interaction with an additional removable slot plug.

Figure 11:
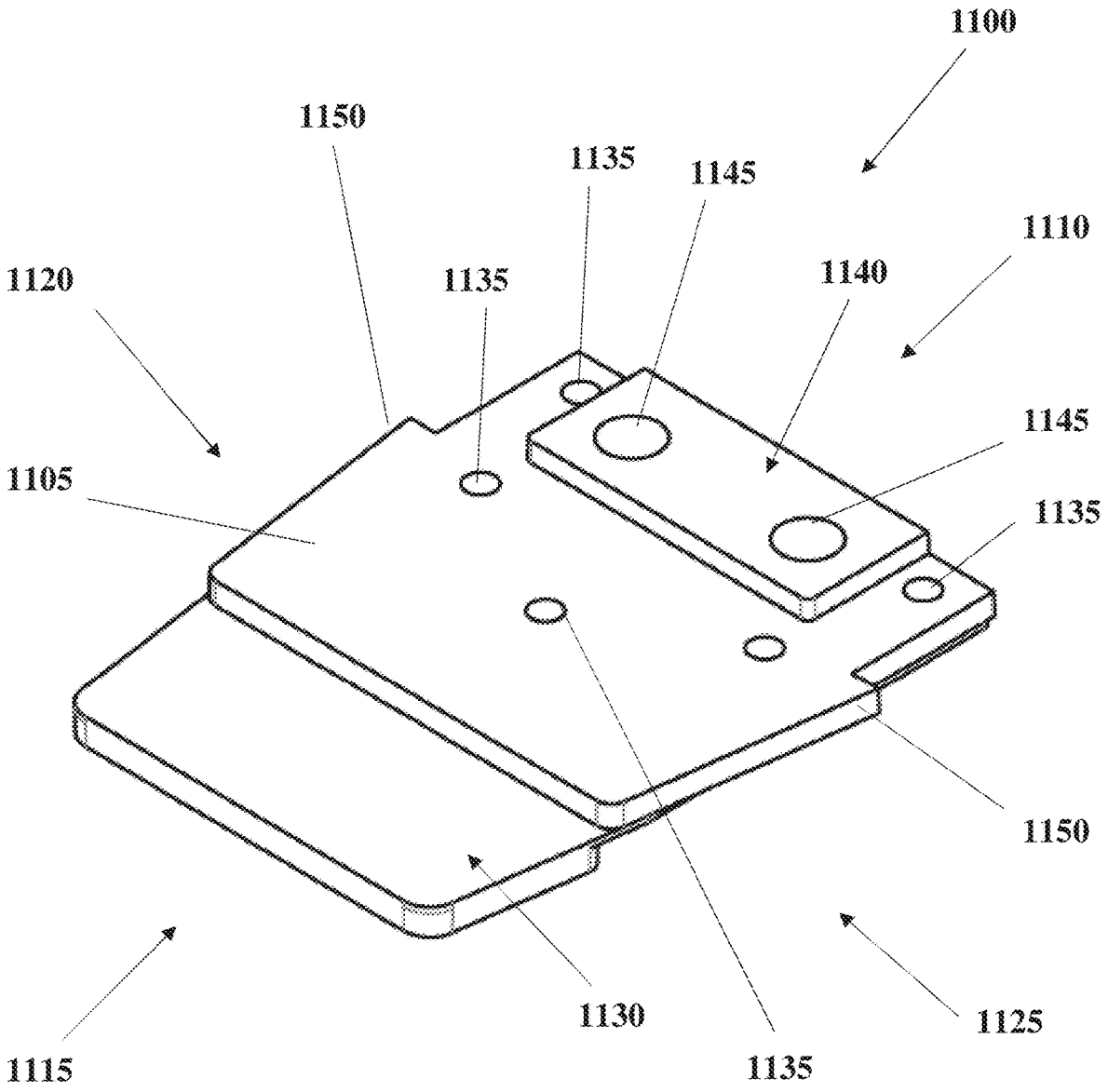
FIG. 11 is an illustration of a top perspective view of one embodiment of a first elevation plate.

FIG. 11 is an illustration of a top perspective view of one embodiment of a first elevation plate 1100. As shown in FIG. 11, the first elevation plate 1100 may comprise a top 1105, front 1110, a rear 1115, two sides 1120, 1125, and a bottom. The top 1105 of the first elevation plate 1100 may comprise a recessed portion 1130 and a protruding portion 1140. The recessed portion 1130 may be configured to matingly engage with the base portion 699 of the replacement heel pedestal top plate 330. The protruding portion 1140 is preferably at a front 1110 and may be configured such that the tongue of the drum foot pedal rests upon it, or otherwise engages with it, providing support and/or an engagement platform. The first elevation plate 1100 may be tapered inward from the front portion 1110 to the rear portion 1115. In this manner, the first elevation plate 1100 may better engage with and support the replacement heel pedestal top plate 330. Similarly, both the left side portion 1120, and right side portion 1125 may have tapered cut wings 1150, which are cut short of the front 1110, which allow the first elevation plate 1100 to flushably or matingly engage with a variety of foot pedal base plates, providing further support.

The first elevation plate 1100 may comprise one or more base plate holes 1135, which may be generally configured to align with the base plate pilot holes of the replacement heel pedestal top plate 330 when the first elevation plate 1100 is matingly engaged with the replacement heel pedestal top plate 330. The base plate holes 1135 of the first elevation plate 1100 may also be configured to align with the base plate fastener holes of the foot pedal base plate when the first elevation plate 1100 is engaged between the replacement pedestal top plate and the base plate of the drum foot pedal. The first elevation plate 1100 may be fastened to the replacement heel pedestal top plate and the base plate of the drum foot pedal via one or more fasteners. The fasteners may be any connection mechanism, device, or method, including, without limitation screws; self-tapping screws; bolts; nails; adhesives; welds; solder; ultrasonic welds; pins, keys; pegs; hook and loop; staples; buttons; zippers; anchors; rivets; grommets; latches; clasps; and clips. If the first elevation plate 1100 is constructed from a material that is engageable with self-tapping screws, the first elevation plate holes 1135 may not be necessary.

The first elevation plate 1100 may comprise one or more tongue holes 1145 within the protruding portion 1140. The tongue holes 1145 may be openings larger than the pilot holes in the pedestal top plate 330 to allow for the screw head types to pass through entirely to attach the tongue to the top plate 330. Typically, the first elevation plate holes 1135 are smaller but may be configured to allow a threaded screw shaft to pass substantially unimpeded.

In one embodiment, the first elevation plate holes 1135 may not be used. The base frame and the tongue are both attached only through the tongue holes 1145. The tongue may be put in place on where the protruding portion 1140 of the base frame connector portion is overlaid, and then the screws are put through to engage with the top plate pilot holes 610.

The tongue holes 1145 of the first elevation plate 1100 may generally be configured to align with the tongue pilot holes of the replacement heel pedestal top plate 330 when the tongue of the drum foot pedal is inserted into the slot opening 620 of the replacement heel pedestal top plate. The tongue holes 1145 of the first elevation plate 1100 may be configured to align with the tongue fastener holes of the base plate of the drum foot pedal when the first elevation plate 1100 engages with the base plate of the drum foot pedal. In this manner, the connector, usually a screw, passes through the base plate, then through the elevation plate, and into the top plate pilot holes 610. This allows the replacement pedestal system to be set to several different elevations.

Preferably the first elevation plate 1100 may have a thickness that allows the replacement heel pedestal top plate 330 to be the same height as at least one type of original heel pedestal. Base plates and heel pedal tongues may come in many different widths, sizes, and shapes and sometimes, when replacing the original heel plate, the pedestal top plate 330 alone may not be able to engage in a level or fitting manner specific to the needs of an individual. The first elevation plate 1100 is designed to engage with both the tongue and the base plate of the heel pedal.

Figure 12:
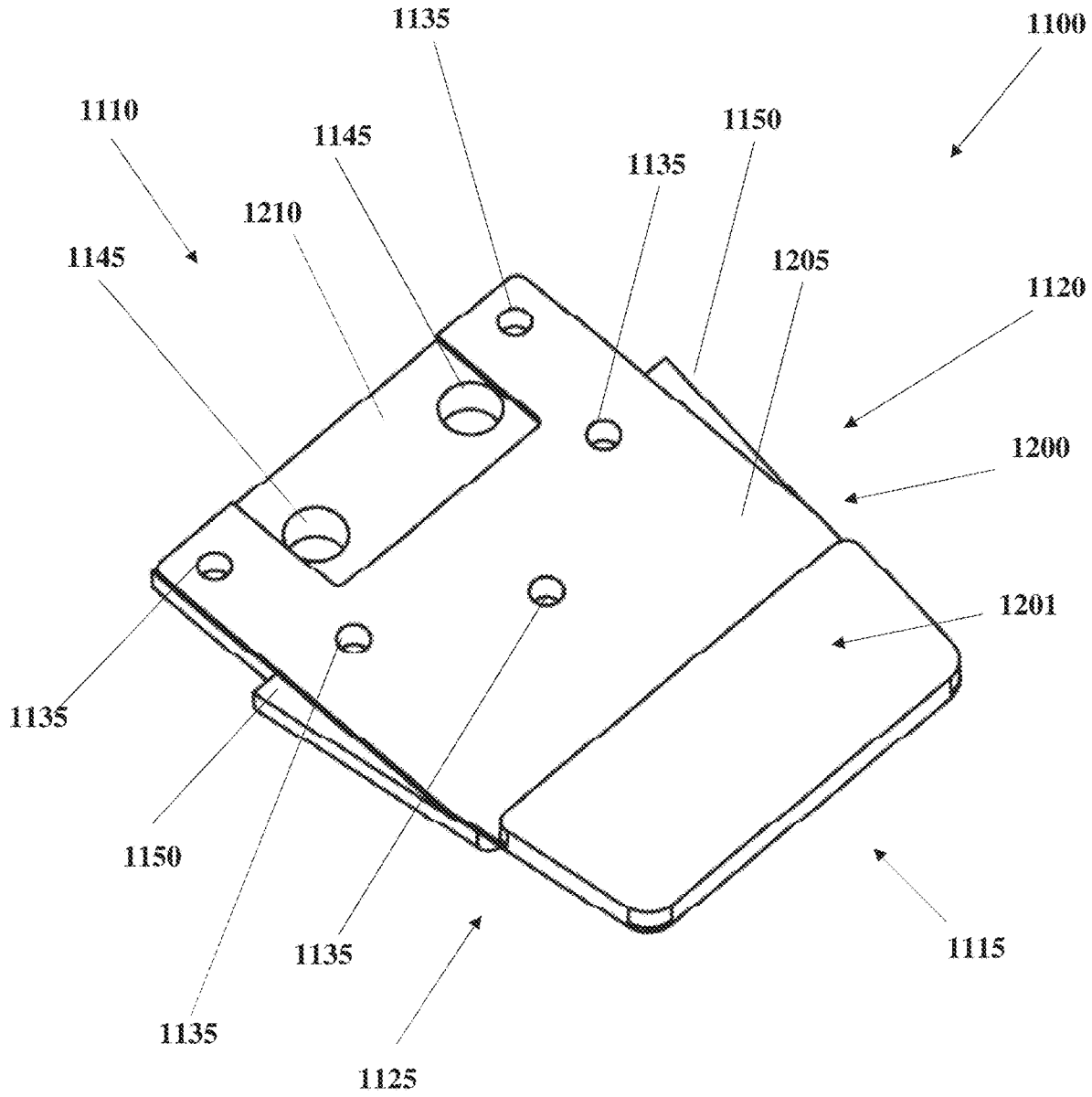
FIG. 12 is an illustration of a bottom perspective view of one embodiment of a first elevation plate.

FIG. 12 is an illustration of a bottom perspective view of one embodiment of a first elevation plate. As shown in FIG. 12, the first elevation plate may comprise a top portion, front 1110, a rear 1115, two sides 1120, 1125, base portion 1201, two tapered cut wings 1150, and a bottom surface 1200. The bottom portion 1200 of the first elevation plate 1100 may comprise a recessed portion 1205 and a slotted portion 1210. The recessed portion 1205 may preferably be between the left side portion 1120 and the right side portion 1125. The recessed portion 1205 may extend from the left side portion 1120 to the right side portion 1125. The recessed portion 1205 may be configured to matingly engage with the base plate of the drum foot pedal. The base portion 1201 may engage with the ground and be level with the base plate of the drum foot pedal. The slotted portion 1210 is preferably at a front portion 1100. The slotted portion 1210 may be configured to matingly engage with the tongue of the drum foot pedal. The first elevation plate 1100 may have cut tapered side wings that stop short from the front portion 1110. In this manner, the first elevation plate 1100 may better engage with the various base plates of a drum foot pedal.

The first elevation plate 1100 may comprise one or more holes 1135, which may be generally configured to align with the base plate fastener holes of the base plate of the drum foot pedal when the first elevation plate 1100 is engaged with the base plate of the drum foot pedal. The base plate holes 1135 of the first elevation plate 1100 may also be configured to align with the base plate pilot holes 615 of the replacement heel pedestal top plate 330 when the first elevation plate 1100 is engaged with the replacement heel pedestal top plate 330. The first elevation plate 1100 may also comprise one or more tongue holes 1145 that may generally align with the tongue holes of the foot pedal and the tongue pilot holes 610 of the replacement heel pedestal top plate 330 The first elevation plate 1100 may be fastened to the base plate of the drum foot pedal and the replacement heel pedestal top plate via one or more fasteners. The fasteners may be any connection mechanism, device, or method, including, without limitation screws; self-tapping screws; bolts; nails; adhesives; welds; solder; ultrasonic welds; pins, keys; pegs; hook and loop; staples; buttons; zippers; anchors; rivets; grommets; latches; clasps; and clips.

The cut tapered side wings 1150 allow replacement heel pedestal system to engage with base plates that are rimmed, such as the DW® 5000 series hi-hat instrument pedal base. The cut tapered side wings 1150 provide uniform sides to the replacement heel pedestal.

Figure 13:
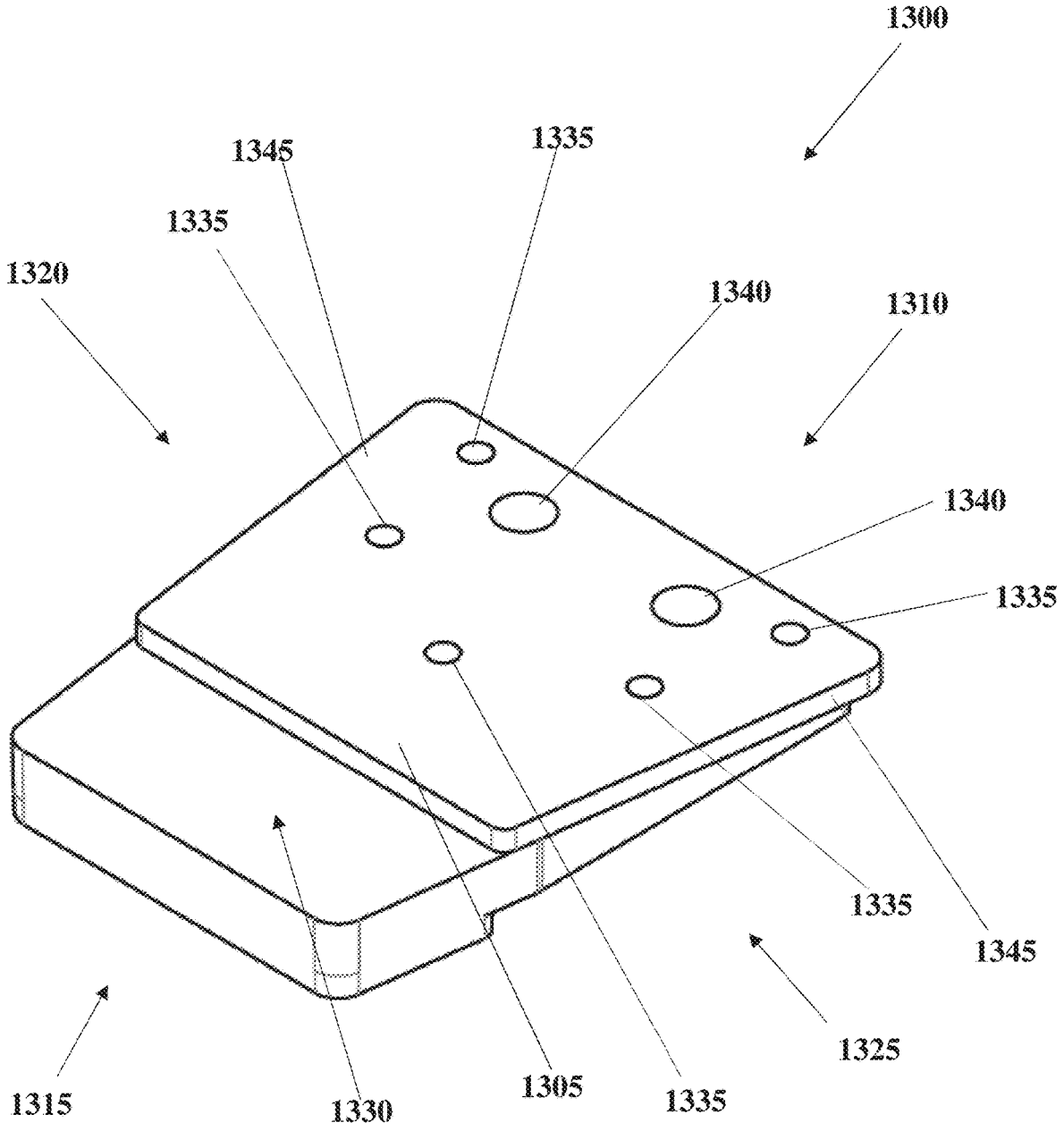
FIG. 13 is an illustration of a top perspective view of one embodiment of a second elevation plate.

FIG. 13 is an illustration of a top perspective view of one embodiment of a second elevation plate. As shown in FIG. 13, the second elevation plate 1300 may comprise a top 1305, front 1310, a rear 1315, two sides 1320, 1325, two tapered side wings 1345 and a bottom. The top 1305 of the second elevation plate 1300 may be substantially flat and may comprise a recessed portion 1330. The recessed portion 1330 is at a rear 1315 of the second elevation plate 1300. The recessed portion 1330 may be configured to matingly engage with the base portion 699 of the replacement heel pedestal top plate 330.

Alternatively, the recessed portion 1330 may be configured to matingly engage with the base portion 1201 of the first elevation plate 1100, if used. In this manner, the first elevation plate may be stacked between the replacement heel pedestal top plate and the second elevation plate 1300.

The top 1305 of the second elevation plate 1300 may be tapered inward from the front portion 1310 to the rear portion 1315, creating two tapered side wings 1345. In this manner, the second elevation plate 1300 may better engage with the replacement heel pedestal top plate 330 and/or the base plate of the drum pedal.

The second elevation plate 1300 may comprise one or more base plate holes 1335 and tongue holes 1340. The holes 1335 may be openings the same diameter or larger than the pilot holes in the pedestal top plate 330 to allow for screw head types to pass through entirely to attach the tongue to the top plate 330. Typically, the holes 1340 are larger than the pilot holes in the pedestal top plate 330 to allow for larger diameter screw heads to recess between the respective plates without impeding fit.

In one embodiment, the holes 1335 may not be used. The base frame, base frame connector plate, and hinge tongue attach only through the tongue holes 1340. The tongue may be placed on or under the top portion 1305 of the elevation plate, aligning the elevation plate tongue holes 1340, the tongue holes, and the top plate pilot holes 610. The base frame connector portion may be overlaid at holes 1340, and then the screws may pass through the base frame, through the holes 1340, through holes on the tongue itself, and then engage with the top plate pilot holes 610. The tongue may be held in place by friction, a clip washer, or nut.

The tongue holes 1340 of the second elevation plate 1300 are generally configured to align with the tongue pilot holes of the replacement heel pedestal top plate 330 when the tongue of the foot pedal is inserted into the slot opening of the replacement heel pedestal top plate. The tongue holes 1340 of the second elevation plate 1300 may be configured to align with the tongue fastener holes of the base plate of the drum foot pedal when the second elevation plate 1300 engages with the base plate of the drum foot pedal. In this manner, the connector, usually a screw, passes through the base plate, then through the elevation plate, and into the top plate pilot holes 615. This allows the replacement pedestal system to be set to several different heights.

In one embodiment, if there is not a base plate, the tongue may simply be connected to the replacement heel pedestal top plate, and the fasteners only engage with the tongue and the top plate.

The base plate holes 1335 of the second elevation plate 1300 may be configured to align with the base plate pilot holes of the replacement heel pedestal top plate when the second elevation plate 1300 matingly engages with the replacement heel pedestal top plate. The base plate holes 1335 of the second elevation plate 1300 may be configured to align with the base plate fastener holes of the base plate of the drum foot pedal when one or more elevation plates 1300 engages with the base plate of the drum foot pedal.

Alternatively, the base plate holes 1335 of the second elevation plate 1300 may be configured to align with the base plate pilot holes of the first elevation plate when the top portion 1305 of the second elevation plate 1300 matingly engages with the bottom portion of the first elevation plate. In this manner, the first elevation plate may be stacked in between the replacement heel pedestal top plate and the second elevation plate 1300.

The second elevation plate 1300 may be fastened to the replacement heel pedestal top plate, first elevation plate, and/or base plate of the drum foot pedal via one or more fasteners. The fasteners may be any connection mechanism, device, or method, including, without limitation screws; self-tapping screws; bolts; nails; adhesives; welds; solder; ultrasonic welds; pins, keys; pegs; hook and loop; staples; buttons; zippers; anchors; rivets; grommets; latches; clasps; and clips.

Figure 14:
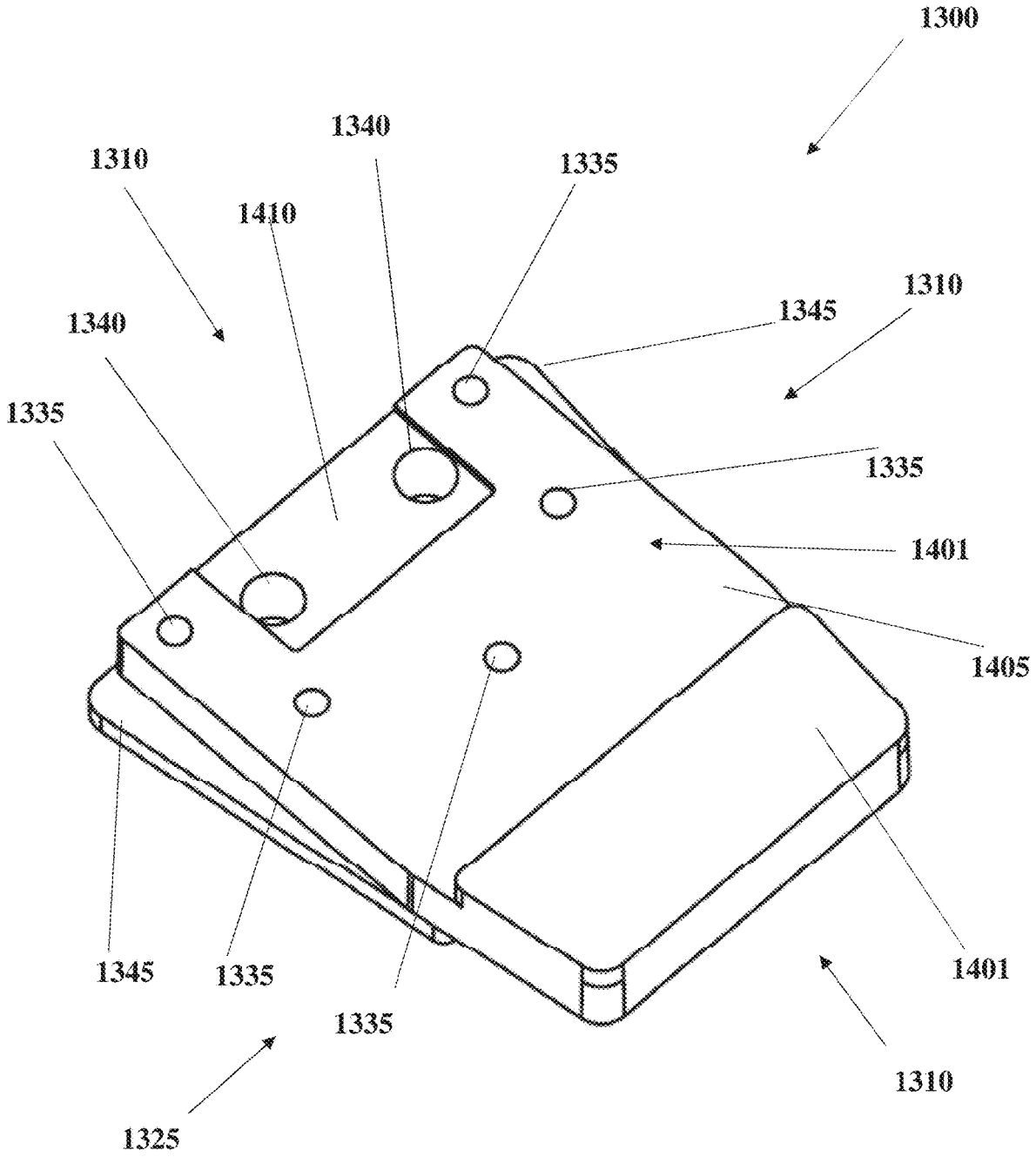
FIG. 14 is an illustration of a bottom perspective view of one embodiment of a second elevation plate.

FIG. 14 is an illustration of a bottom perspective view of one embodiment of a second elevation plate. As shown in FIG. 14, the elevation plate may comprise a top, front 1310, a rear 1315, two sides 1320, 1325, two tapered side wings 1345 and a bottom surface 1400. The bottom surface 1400 of the second elevation plate 1300, like the top, may be substantially flat and may comprise a recessed portion 1405, a bottom portion 1401, and a slotted portion 1410. The recessed portion 1405 may be configured to matingly engage with the top of base plate of a drum foot pedal.

The bottom portion 1401 may be engaged with the ground or, if more than one second elevation plate is used, with recessed portion 1330. When one or more elevation plates 1300 are used, the recessed portion 1405 may be configured to matingly engage with the top portion 1305 of the other second elevation plate 1300.

The slotted portion 1410 is preferably at a front 1310 and may be configured to matingly engage with a foot pedal base plate or the tongue. Similarly, the tapered side wings 1345 on the left side portion 1320 and right side portion 1325 may be configured such that they rest flush against elevated sides of a foot pedal base plate. The wings 1345 may be tapered from the front portion 1310 to the rear portion 1315. In this manner, the second elevation plate 1300 may better engage with a raised lip of the base plate of the drum foot pedal and align with the wings 625 of the top plate.

The second elevation plate 1300 may comprise one or more holes 1335, 1340, which may be tongue holes 1340 (which may also be referred to as screw head opening holes, because they are primarily there to allow a screw to pass entirely through the hole) and base plate holes 1335. The tongue holes 1340 of the second elevation plate 1300 are generally configured to align with the tongue pilot holes of the replacement heel pedestal top plate when the tongue of the drum foot pedal is inserted into the slot opening of the replacement heel pedestal top plate. The tongue holes 1340 of the second elevation plate 1300 may be configured to align with the tongue fastener holes of the base plate of the drum foot pedal when the second elevation plate 1300 mates or engages with the base plate of the drum foot pedal. The base plate holes 1335 of the second elevation plate 1300 may be configured to align with the base plate pilot holes of the replacement heel pedestal top plate when the second elevation plate 1300 matingly engages with replacement heel pedestal top plate 330. The base plate holes 1335 of the second elevation plate 1300 may be configured to align with the base plate fastener holes of the base plate of the drum foot pedal when the second elevation plate 1300 matingly engages with the base plate of the drum foot pedal.

Further, when one or more elevation plates 1300 are used, the tongue holes 1340 of a first elevation plate may be generally configured to align with the tongue holes 1340 of a second elevation plate. Similarly, the base plate holes 1135 of a first elevation plate may be generally configured to align with the base plate holes 1335 of a second elevation plate, when both a first and a second elevation plate 1100, 1300 are used.

The second elevation plate 1300 may be fastened to the replacement heel pedestal top plate, base plate of a drum foot pedal, a first elevation plate and/or another second elevation plate via one or more fasteners. The fasteners may be any connection mechanism, device, or method, including, without limitation screws; self-tapping screws; bolts; nails; adhesives; welds; solder; ultrasonic welds; pins, keys; pegs; hook and loop; staples; buttons; zippers; anchors; rivets; grommets; latches; clasps; and clips.

Figure 15:
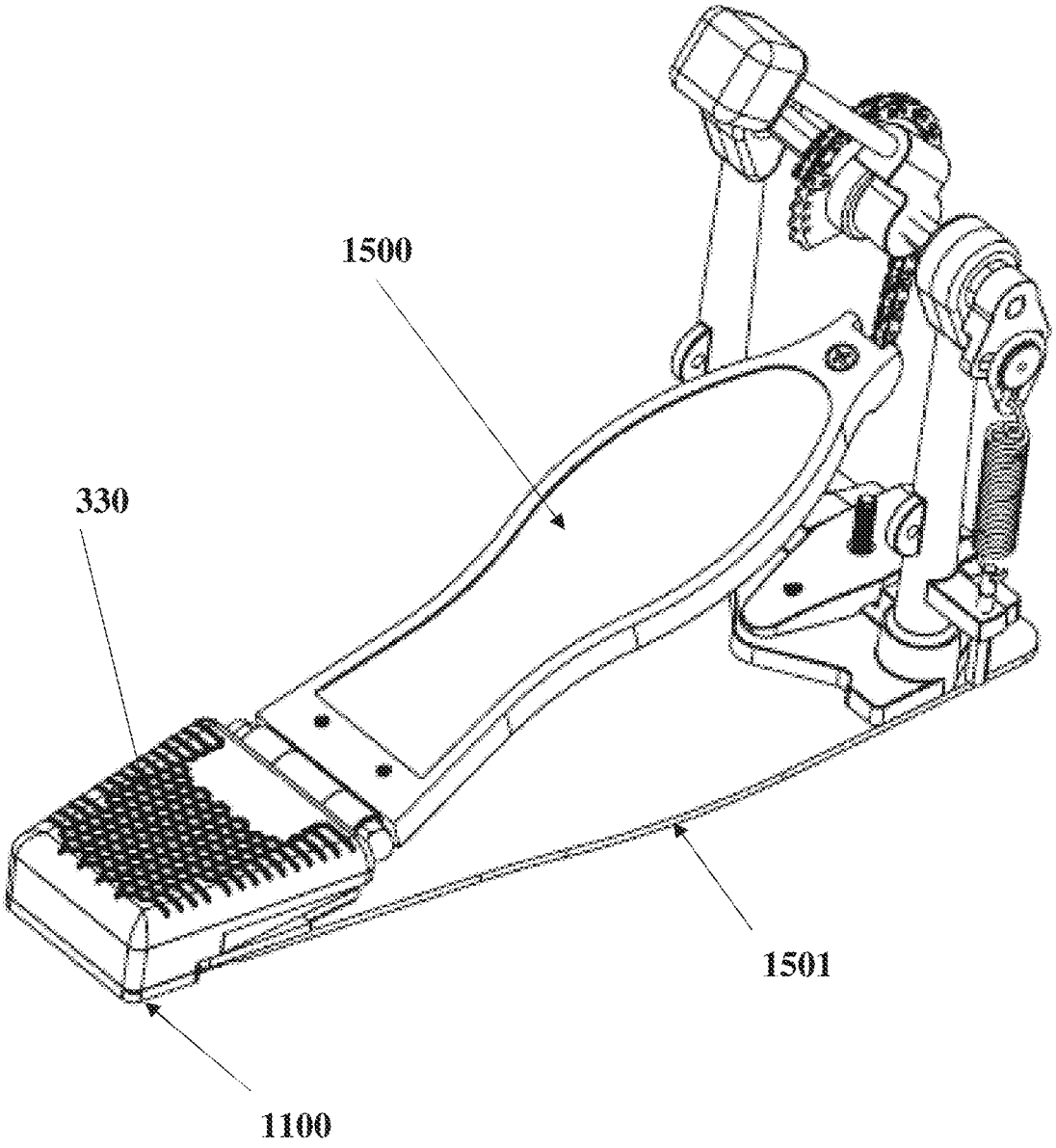
FIG. 15 is an illustration of an assembled perspective view of a drum foot pedal with a replacement heel pedestal top plate and a first elevation plate.

FIG. 15 is an illustration of an assembled perspective view of a drum foot pedal with a replacement heel pedestal top plate and a first elevation plate. In one embodiment, the replacement heel pedestal top plate 330 may be removably and matingly coupled to a first elevation plate 1100. The first elevation plate 1100 may aid the replacement heel pedestal top plate 330 in achieving an elevation or height compatible to an individual's needs when matingly engaged with the base plate 1501 of the drum foot pedal 1500.

Figure 16:
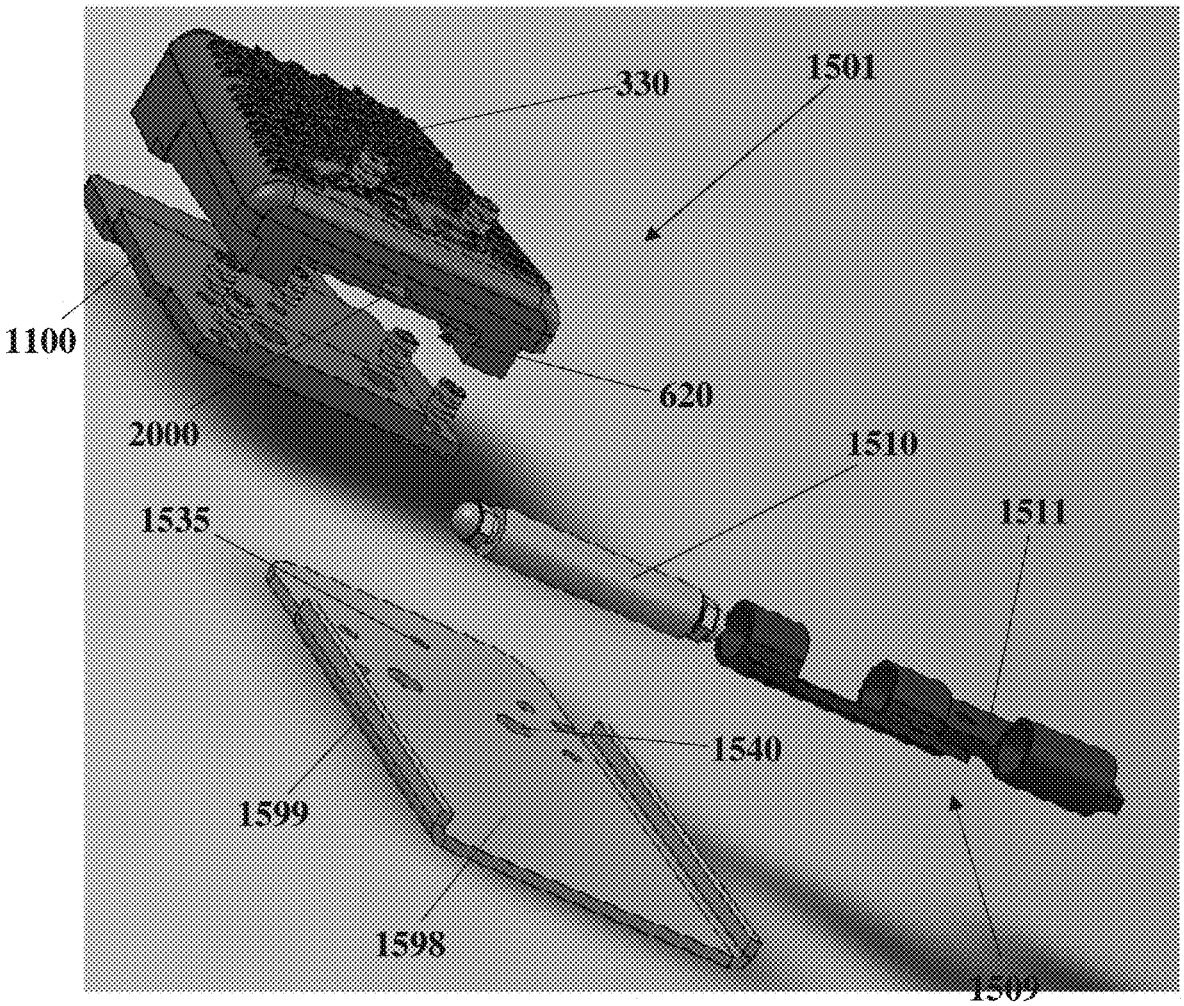
FIG. 16 is an illustration of an exploded view of one embodiment of the replacement heel pedestal system showing the top plate and a first elevation plate.

FIG. 16 is an illustration of an exploded view of one embodiment of the replacement heel pedestal system showing the top plate and a first elevation plate. As shown in FIG. 16, the bottom of top plate 330 may be configured to matingly engage with the top of the first elevation plate 1100. As show the slot plug 2000 may be engaged with a top of slot opening 620. The tongue 1511 of the heel pedal may be configured to engage with slot opening 620 and be held firmly, but removeably, in place between the slot plug 2000 and the elevated portion 1140 of the first elevation plate 1100. In this manner the foot pedal is hingedly connected to the replacement heel pedestal system. FIG. 16 shows that the heel pedal may comprise hinge 1509, tongue 1511, and hinge pin 1510. The base plate 1598 may comprise base plate holes 1535 and tongue holes 1540, which allow the fasteners to engage or pass through. The base plate 1598 may also comprise a lip or rim 1599.

Figure 17:
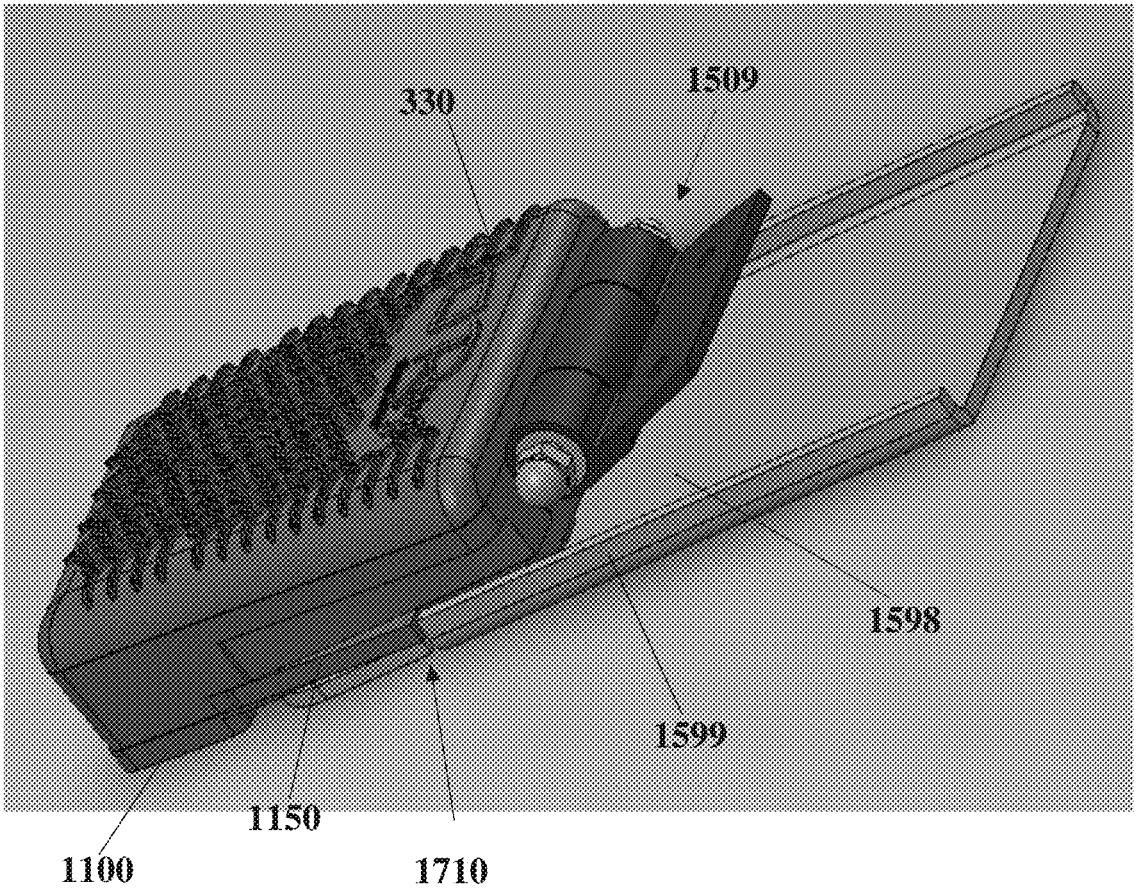
FIG. 17 is an illustration of an assembled view of one embodiment of the replacement heel pedestal system showing the top plate and a first elevation plate.

FIG. 17 is an illustration of an assembled view of one embodiment of the replacement heel pedestal system showing the top plate and a first elevation plate. As shown in FIG. 17, the bottom of top plate 330 may be configured to matingly engage with the top of the first elevation plate 1100. The tongue 1511 (shown in FIG. 16) of the heel pedal may be configured to engage with slot opening 620 and be held firmly, but removeably, in place between the slot plug 2000 and the elevated portion 1140 of the first elevation plate 1100. In this manner the foot pedal is hingedly connected to the replacement heel pedestal system. The base plate 1598 may comprise a lip or rim 1599, which matingly fits 1710 with cut wing 1150 on either side of the first elevation plate 1100. This protruding cut wing 1150 provides the replacement heel pedestal system stability, strength, and a mating fit 1710 with the base plate 1598.

Figure 18:
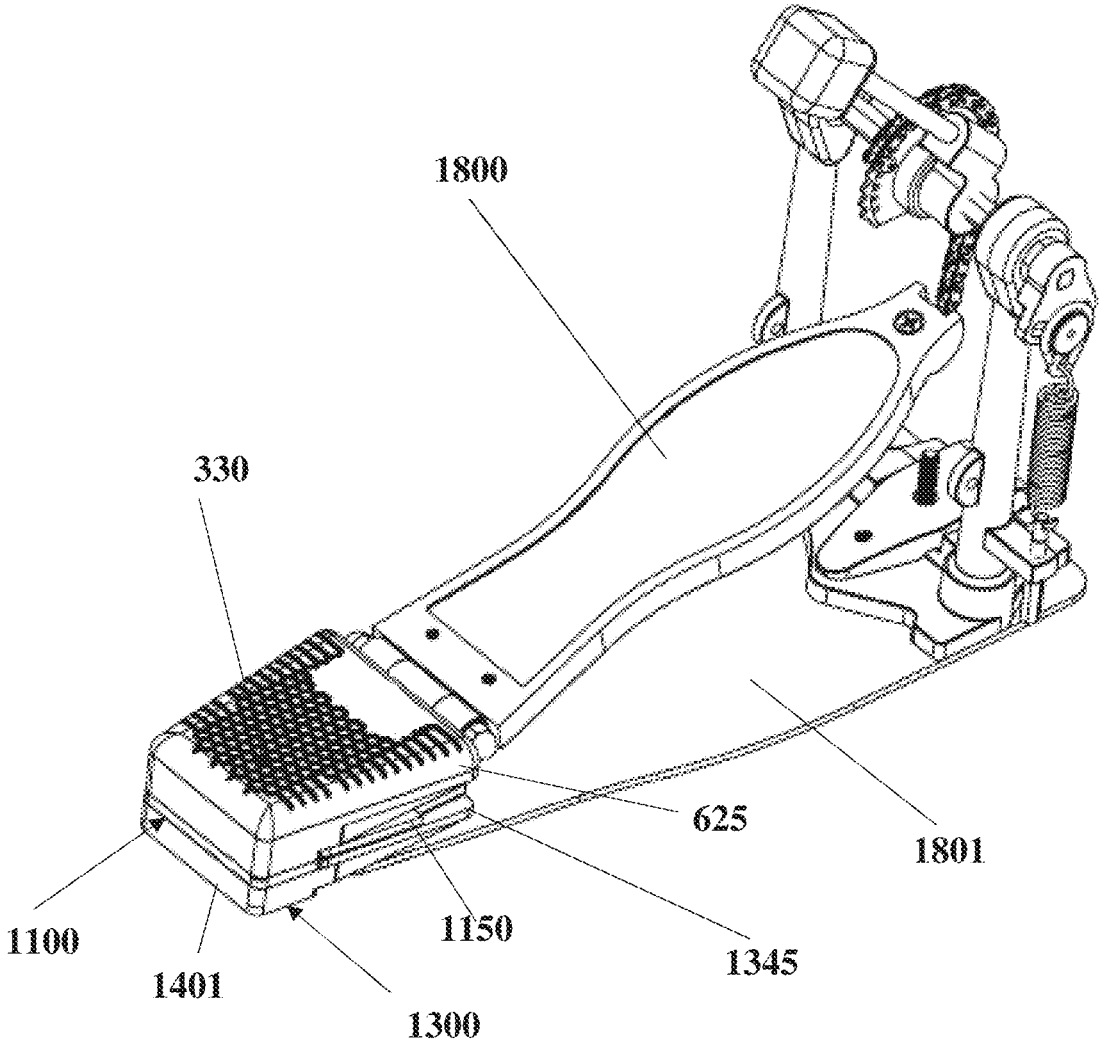
FIG. 18 is an illustration of an assembled perspective view of a drum foot pedal with a replacement heel pedestal top plate, a first elevation plate, and a second elevation plate.

FIG. 18 is an illustration of an assembled perspective view of a drum foot pedal with a replacement heel pedestal top plate, a first elevation plate and a second elevation plate. In one embodiment, the replacement heel pedestal top plate 330 may be removably coupled to a first elevation plate 1100 and a second elevation plate 1300. The second elevation plate 1300 may provide an incremental adjustment for a more stable and/or elevated playing position for the foot and overall body positioning. This allows the foot to more easily access and engage with the footboard or pedal, improving stability. By using correct ergonomic foot positioning relative to actuating the drum foot pedal 1800, a drummer may have more foot control, stability, and comfort with less muscle, leg, and back fatigue, due to the proper alignment of the foot, ankle, and heel in relation to the leg, hip, and back posture while seated or standing during use. The replacement heel pedestal system is configured to be hingedly connected to the pedal 1800 and firmly connected to the base plate 1801. The bottom of bottom portion 1401 of the second elevation plate is show level with the bottom of the base plate 1801. Thus, the base plate 1801 and the second elevation plate 1300 may be matingly engaged with each other to provide improved stability at the base of the drum pedal.

Figure 19:
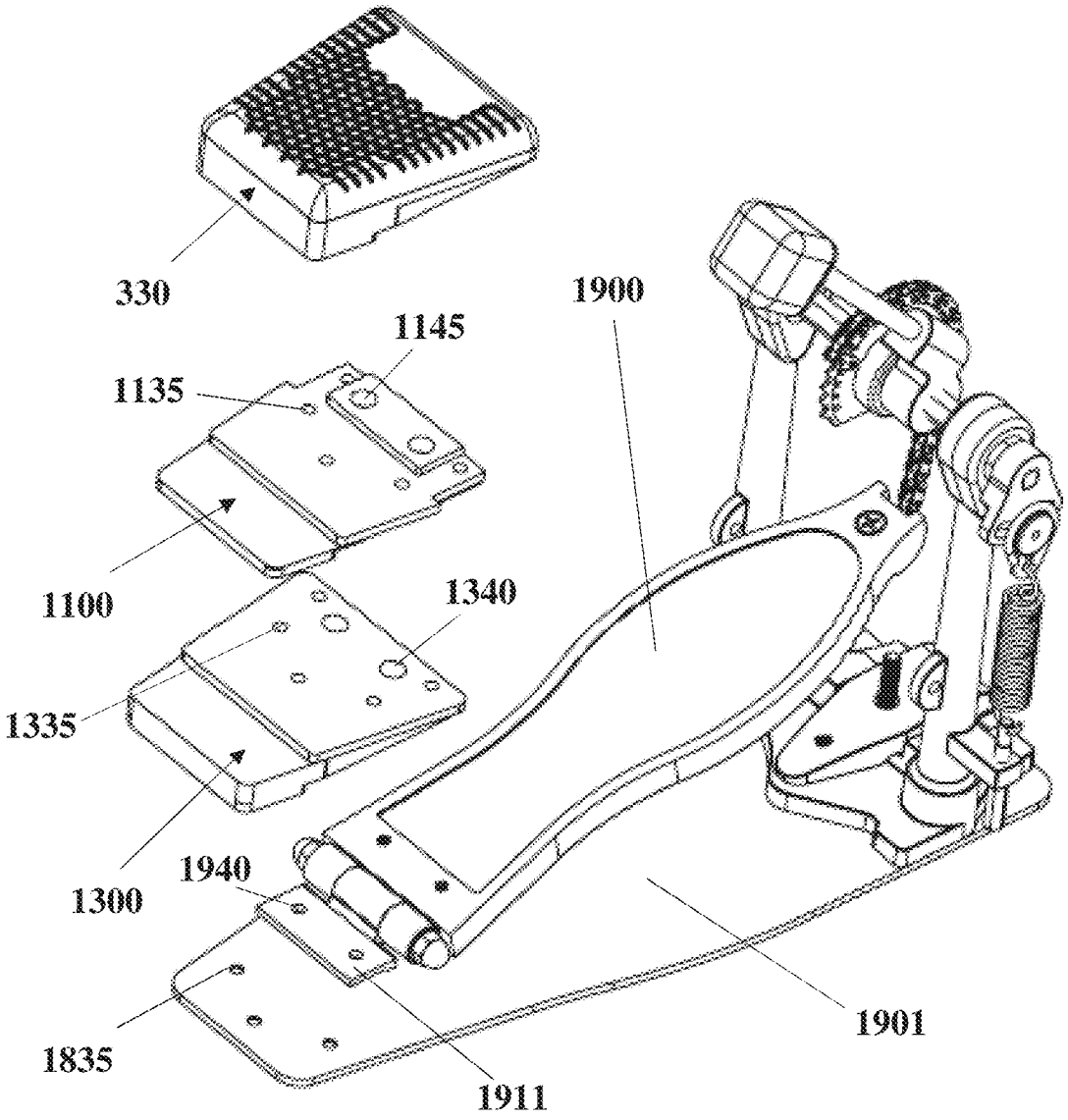
FIG. 19 is an illustration of an exploded perspective view of a drum foot pedal with a replacement heel pedestal top plate, a first elevation plate, and a second elevation plate.

FIG. 19 is an illustration of an exploded perspective view of a drum foot pedal with a replacement heel pedestal top plate, a first elevation plate, and a second elevation plate. As shown in FIG. 19, the base plate 1901 provides a platform for the replacement heel pedestal system to connect. The second elevation plate 1300 may be matingly connected to the base plate 1901 and the elevation plate 1100, which itself is connected to the top plate 330. FIG. 19 shows that the base plate holes 1835, 1335, 1135 may be aligned such that a fastener may connect the base plate 1901, the first elevation plate 1100, and the second elevation plate 1300 to the top plate 330. FIG. 19 shows that tongue 1911 may have tongue holes 1940, which are aligned with tongue holes 1340, 1145, such that the tongue may be securely fastened to top plate 330. The tongue holes 1340 and 1145 allow access to the tongue fastener heads to pass through the tongue holes when removing or connecting the system to the pedal 1900.

Figure 20:
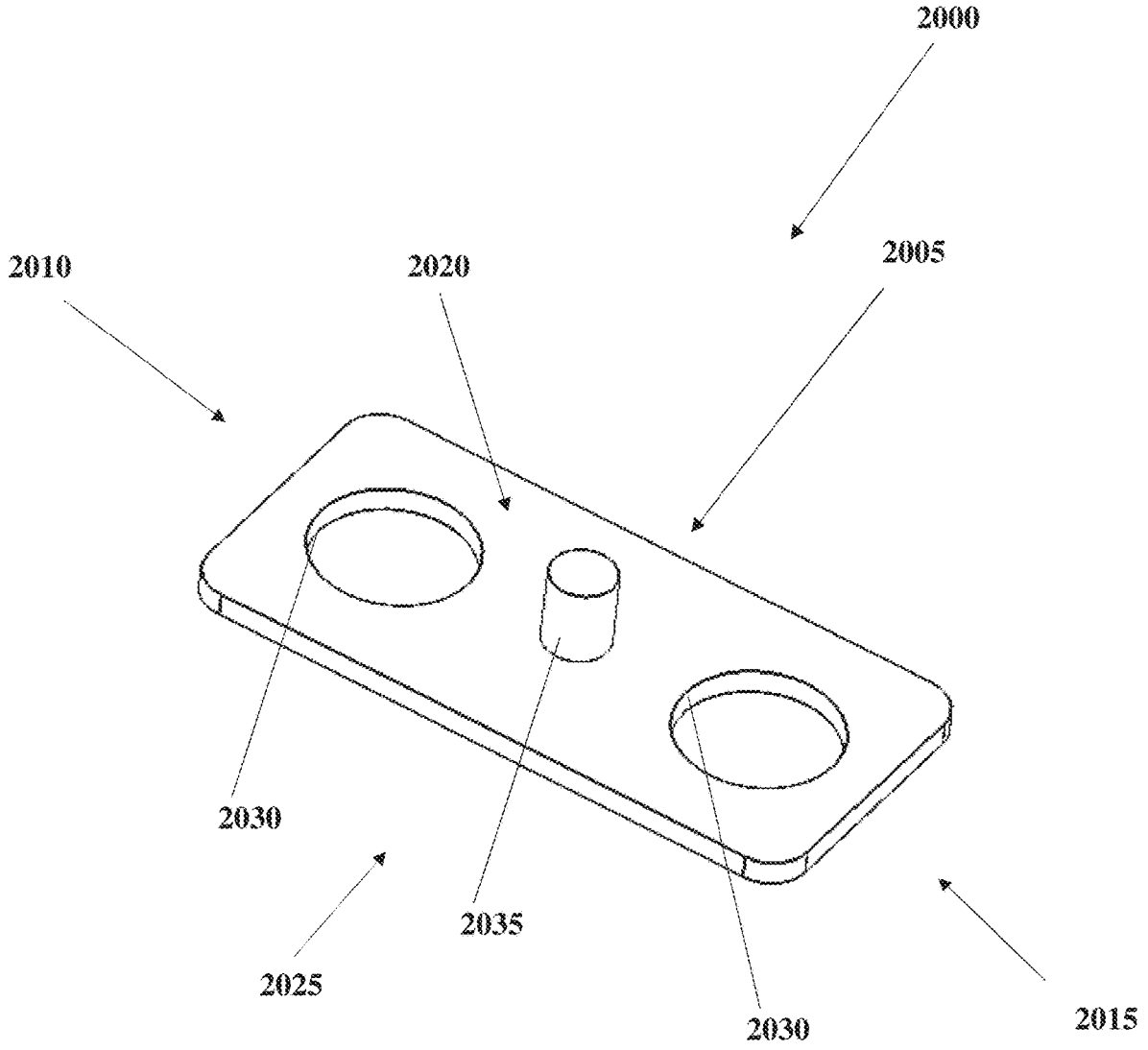
FIG. 20 is a perspective view of a removable slot plug.

FIG. 20 is a perspective view of a removable slot plug. As shown in FIG. 20, the removeable slot plug 2000 comprises a front 2005; a bottom; two sides 2010, 2015; a top 2020; a rear 2025. The removeable slot plate 2000 may contain one or more tongue holes 2030, through which any connection mechanism, device, or method, including, without limitation: screws; self-tapping screws; bolts; nails; adhesives; welds; solder; ultrasonic welds; pins, keys; pegs; hook and loop; staples; buttons; zippers; anchors; rivets; grommets; latches; clasps; or clips may pass to connect the top plate and either a first elevation plate, second elevation plate, base plate, base frame, or combination thereof. The peg 2035 may connect with the top plate through the peg slot 635, effectively covering the grooves in the top plate 330 (which may eliminate the need for bushings) and allowing for more versatility of use. The slot plug 2000 may have various thicknesses to allow the user to engage with various drum pedal tongues.

Figure 21:
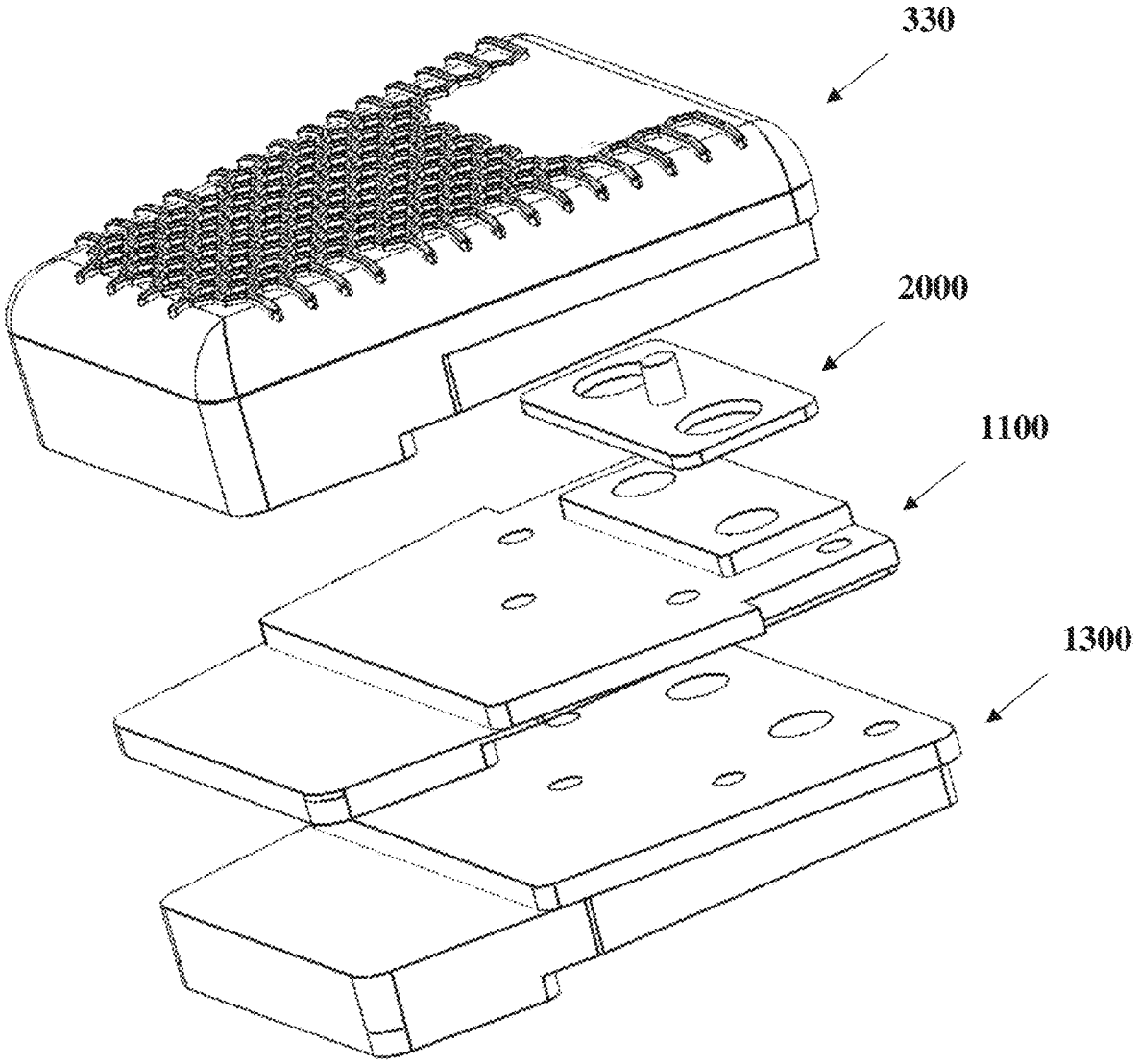
FIG. 21 is an exploded perspective view of a replacement heel pedestal system showing the top plate, the slot plug, a first elevation plate, and a second elevation plate.

FIG. 21 is an exploded perspective view of a replacement heel pedestal system showing the top plate, the slot plug, a first elevation plate, and a second elevation plate. As shown in FIG. 21, the system may comprise a top plate 330, removeable slot plate 2000, first elevation plate 1100, and second elevation plate 1300. The recessed top portions and protruding bottom portions of each plate allow them to matingly interconnect with other plates in a manner that they may interlock in a very stable manner.

Figure 22:
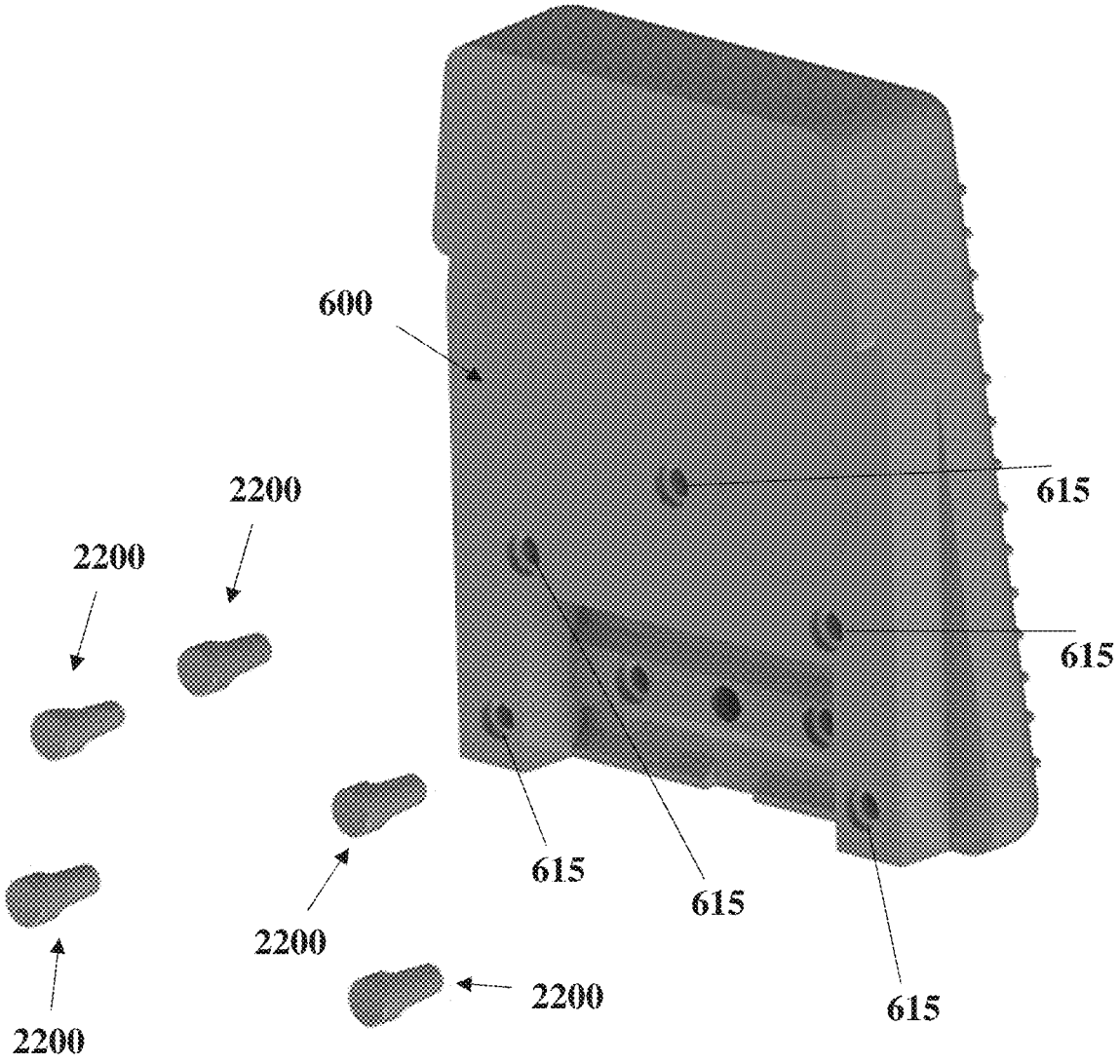
FIG. 22 is an illustration of an exploded bottom perspective view of one embodiment of a replacement heel pedestal top plate and pilot hole protection plugs.

FIG. 22 is an illustration of an exploded bottom perspective view of one embodiment of a replacement heel pedestal top plate and pilot hole protection plugs 2200. FIG. 22 shows that the bottom surface 600 has a plurality of pilot holes 615. The shape of the pilot hole protection plugs 2200 allow them to insert into the pilot holes 615, preventing the pilot holes from accumulating debris.

Figure 23:
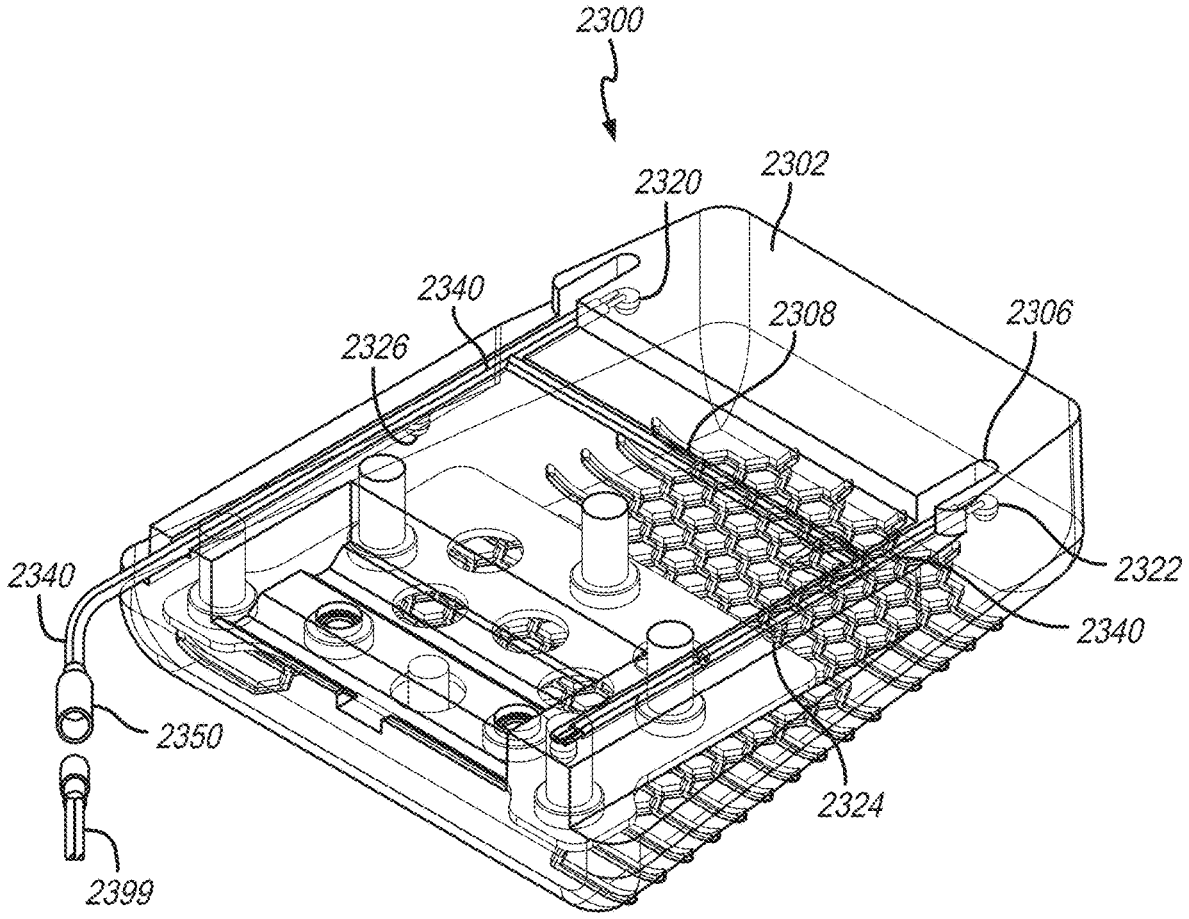
FIG. 23 is an illustration of a bottom perspective view of an illuminated replacement heel pedestal top plate showing the wiring harness in a groove.

FIG. 23 is an illustration of a bottom perspective view of an illuminated replacement heel pedestal top plate showing the wiring harness in a groove. FIG. 23 shows that illuminated replacement heel pedestal top plate 2300 is transparent, has a bottom portion 2302, and may be substantially similar in form and function to top plate 330 shown in FIG. 10. Top plate 2300 may comprise bottom grooves 2304, 2306, 2308, which may be configured to house wiring harness 2340, which may substantially extend across the length and width of top plate 2300. The wiring connects lights 2320, 2322, 2324, 2326, and provides the lights 2320, 2322, 2324, 2326 with electrical power when adapter 2350 is connected to outlet 2399, which may be connected to the power grid or a battery. The lights 2320, 2322, 2324, 2326 may be controlled by an on/off switch or by simply disconnecting the adapter 2350 from outlet 2399. A light switch is an electrical device that is used to break the circuit, interrupting the current and to supply the current from one conductor to another conductor. The switch may work with an ON and OFF mechanism. Switches may be classified into four types, such as (SPST) single pole single throw, (SPDT) single pole double throw, (DPST) double pole single throw, and (DPDT) double pole double throw. The type of switch (s), trigger(s) or touch controlled load switch(s) used will depend on the connections of the circuit they make to the drum or percussion kit; too include each drum pedal used with the illuminated systems top plate attached. Alternatively, the lights 2320, 2322, 2324, 2326 may be controlled by a lighting switch or board that is connected to the user's drums or drum lights. The lights may be any color, and if LED, as preferred and as shown, the lights may vary in color and brightness as part of a variable light show. The lights may be of any type, such as Light Emitting Diode (LED), Compact Flourescent Light Bulb (CFL), or Incandescent Bulb. The lights may be of any shape, size, strip, or any type of self-contained, short-term light-source, such as a translucent plastic tube containing isolated substances that, when combined, make light through chemiluminescence, so it does not require an external energy source. And they may be of any color. The type of lights shown in the drawings are Diode/LED (Light Emitting Diode). A diode is a device, which is made from semiconductor material that allows current to flow in one direction; it blocks the current that tries to go against the flow in a wire. These devices are often used in many electronic circuits that convert AC to DC. A LED is the alternative of the diode, when a current is applied to a LED, it emits light at a particular frequency. LEDs are used in numerous applications, including in drum light kits, keyboards, system status indicators in computers, as well as battery-operated electronics transistors.

FIG. 23 shows that the wiring harness may exit the housing grooves 2304 at a front end of the top plate 2300. But the grooves may be configured to run in any direction and the wiring harness 2340 may extend away from the top plate 2300 from any side, including the top or the bottom. Because the top plate 2300 is transparent or translucent, the lights 2320, 2322, 2324, 2326 may provide illumination to the user when setting up, drumming, or breaking down. One of the benefits to having a groove for the wire harness 2340 is that the wire harness 2340 and lights 2320, 2322, 2324, 2326 may be more easily accessed or replaced as compared to an embedded system.

Figure 24:
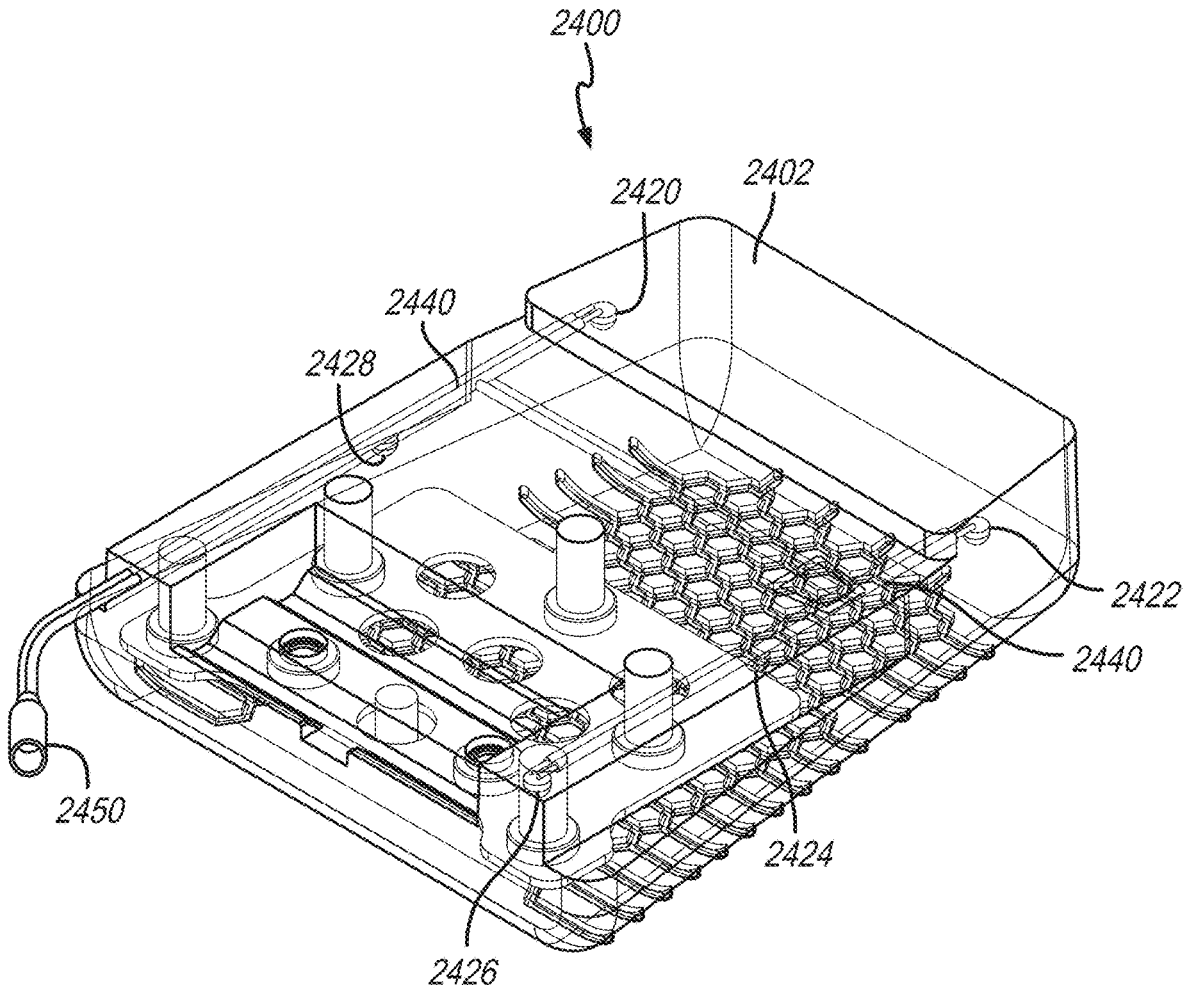
FIG. 24 is an illustration of a bottom perspective view of an illuminated replacement heel pedestal top plate showing the wiring harness embedded.

FIG. 24 is an illustration of a bottom perspective view of an illuminated replacement heel pedestal top plate showing the wiring harness embedded. FIG. 24 shows that illuminated replacement heel pedestal top plate 2400 is transparent, has a bottom portion 2402, and may be substantially similar in form and function to top plate 330 shown in FIG. 10. The wiring harness 2440 may connect lights 2420, 2422, 2424, 2426, 2428, and provide the lights 2420, 2422, 2424, 2426, 2428 with electrical power when adapter 2450 is connected to a power connector that allows electronic devices to connect to available power outlets, which may be connected to the power grid, a battery, or some other type of electrical energy transmission system, electromechanical system (such as generators and alternators), solar power converters, energy storage devices (such as a battery and fuel cells), or other power supply source. The system may also include a switch or electrical device that is used to break or make an electrical circuit manually or automatically. The working principle of switch depends on the specific ON/OFF mechanism used. Various electrical or electronic circuits may use switches to control or trigger the circuit. The types of switches depend on the connections of the circuit they make and can be accessed through hatch 2560. FIG. 24 shows that the wiring harness may exit the top plate 2300 at the front end of top plate 2400. But, the wiring harness 2440 may extend away from the top plate 2400 from any side, including the top or the bottom. Because the front end of top plate 2400 faces the drum pedal and drum kit, this is a preferred side for the wire to enter the top plate 2400. One of the benefits to having an embedded wire harness 2440 is that the wires are not exposed, which makes the wires less likely to be damaged.

Figure 25:
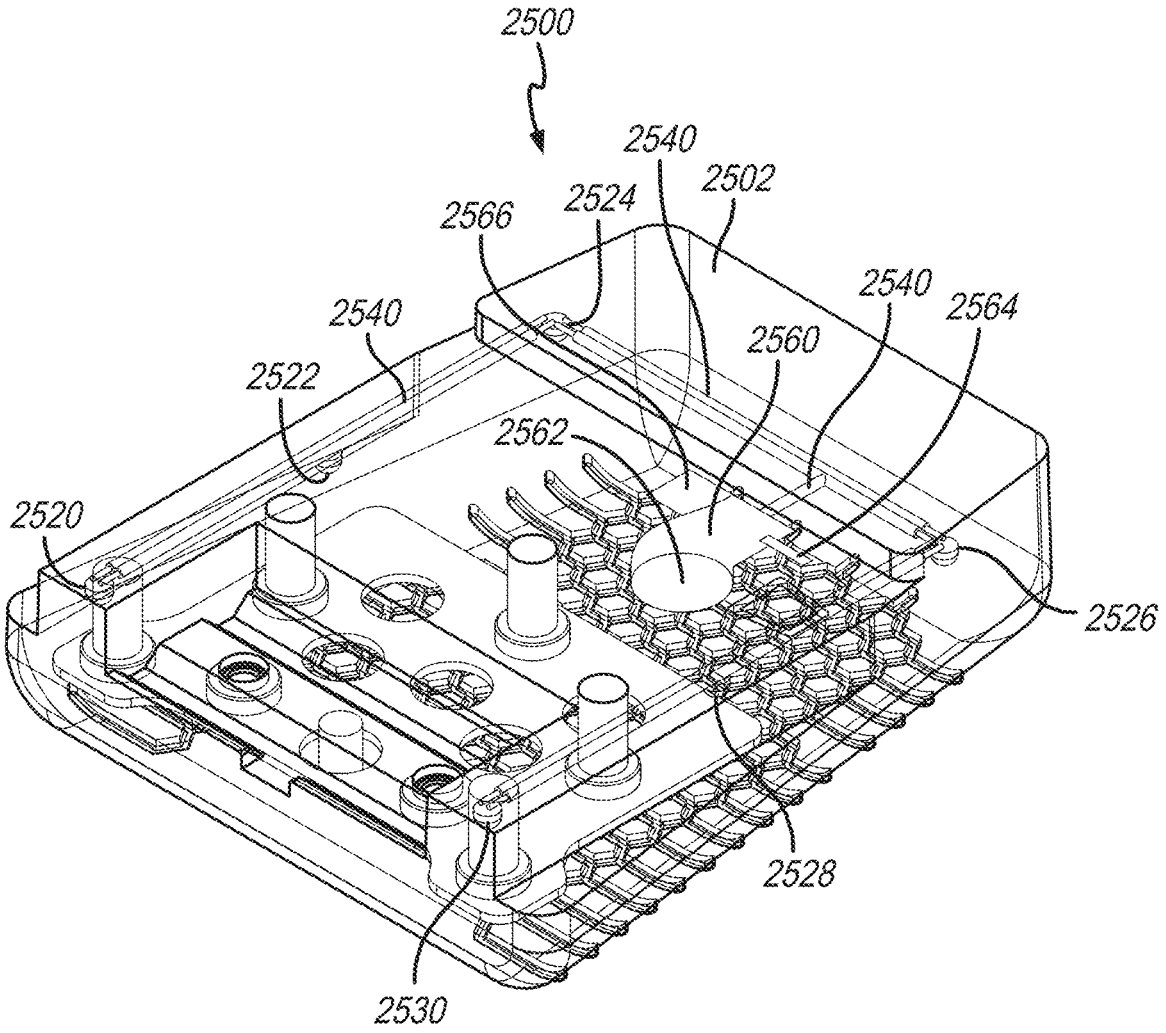
FIG. 25 is an illustration of a bottom perspective view of an illuminated replacement heel pedestal top plate showing the wiring harness embedded and operating under battery power.

FIG. 25 is an illustration of a bottom perspective view of an illuminated replacement heel pedestal top plate showing the wiring harness embedded and operating under battery power. As shown in FIG. 25, the illuminated replacement heel pedestal top plate 2500 is transparent, has a bottom portion 2502, and may be substantially similar in form and function to top plate 330 shown in FIG. 10. The wiring harness 2540 may connect lights 2520, 2522, 2524, 2526, 2528, 2530 and provide the lights 2420, 2422, 2424, 2426, 2428 with electrical power from battery 2562. The lights 2420, 2422, 2424, 2426, 2428 may be switched on or off using toggle 2564, which may be a digital or analog switch or button and may be accessed through hatch 2560. Hatch 2560 may be any type of door or removeable panel that allows the user to access and change battery 2562. The top plate 2500 may also have a controller 2566 that may have a transceiver to send and receive electronic communications. In this manner, the illuminated top plate 2500 may be remotely controlled. The system may use an RGB LED product that combines Red, Blue, and Green colors to produce over 16 million hues of light. RGB LED strips can be used in place of single LED lights installed in top plate 2500. Both LED light sources can be controlled with LED driver circuitry controlled manually at the switch or through remote actuation to illuminate top plate 2500.

Figure 26:
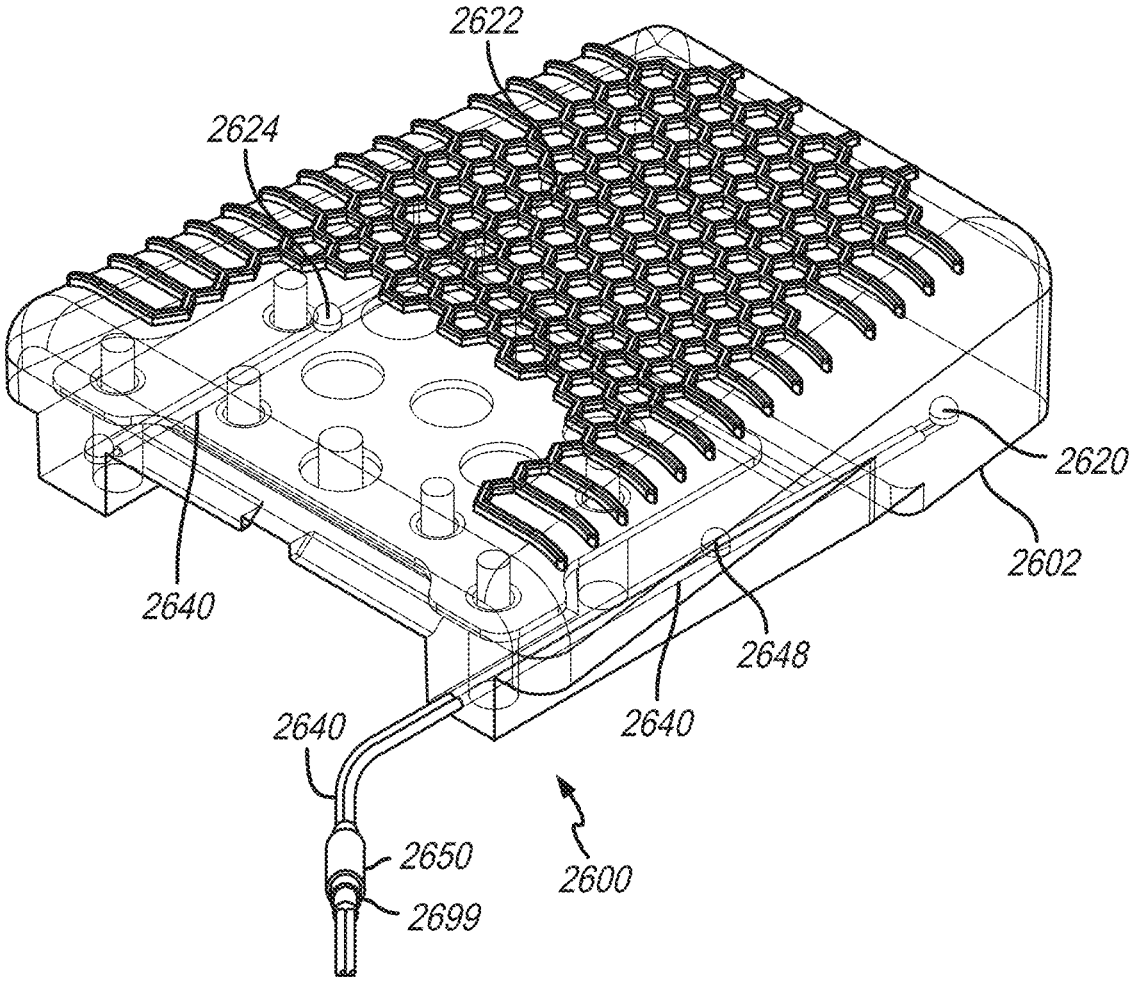
FIG. 26 is an illustration of a top perspective view of an illuminated replacement heel pedestal top plate showing the wiring harness embedded.

FIG. 26 is an illustration of a top perspective view of an illuminated replacement heel pedestal top plate showing the wiring harness embedded. FIG. 26 shows that illuminated replacement heel pedestal top plate 2600 is transparent and may be substantially similar in form and function to top plate 330 shown in FIG. 10. Top plate 2300 may house wiring harness 2640, which may substantially extend across the length and width of top plate 2600. The wiring connects lights 2620, 2622, 2624, 2648, which are shown as illuminated, and provides the lights 2620, 2622, 2624, 2648 with electrical power when adapter 2650 is connected to outlet 2699, which may be connected to the power grid or a battery.

Although the lights are preferably LED lights, other types of lights may be used. Although four or six lights are shown being used, any number of lights may be used. Although the Light Emitting Diode (LED) is shown, other types of light sources are available and can be used in place of the LED. In addition, the number of individual lights used in conjunction with the wiring harness installed in the illuminated top plate can vary depending on the illumination requirements.

The previous description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that an order be inferred, in any respect. This holds for any possible non-express basis for interpretation, including: matters of logic with respect to arrangement of steps or operational flow; plain meaning derived from grammatical organization or punctuation; the number or type of embodiments described in the specification.

It will be apparent to those of ordinary skill in the art that various modifications and variations may be made without departing from the scope or spirit. Other embodiments will be apparent to those skilled in the art from consideration of the specification and practice disclosed herein. It is intended that the specification and examples be considered as exemplary only, with a true scope and spirit being indicated by the following claims.

What is claimed is:

1. A replacement heel pedestal system comprising:

a top plate;

wherein said top plate comprises a one or more lights and a wiring harness;

wherein said wiring harness is configured to connect said one or more lights to a power source, such that when said power source is turned on said one or more lights are illuminated;

wherein said top plate is configured to replace an original equipment heel plate and wherein said top plate has a width that is wider than a width of said original equipment heel pedestal.

2. The system of claim 1, wherein said top plate further comprises: a front that is wider than a rear; a top portion; a bottom portion; a screw receiving plate that is substantially contained between said bottom portion and said top portion; a top surface; a slot opening; a recessed portion; and one or more tongue pilot holes;

wherein at least said top surface and said top portion of said top plate are transparent;

wherein said slot opening is a female notch on said front of said top plate that is configured to allow said top plate to couple with a tongue of a foot pedal, such that said top plate and said foot pedal are hingedly coupled together;

wherein said recessed portion is on said bottom and said front of said top plate;

wherein said screw receiving plate comprises one or more receiver nuts that are aligned with at least said one or more tongue pilot holes and are configured to allow one or more fasteners to couple said top plate to said tongue of said foot pedal; and wherein said top portion of said top plate comprises two tapered side wings that extend beyond a width of said bottom portion of said top plate and that taper inward from said front to said rear.

3. The system of claim 2, wherein said top plate further comprises one or more base plate pilot holes;

wherein said recessed portion of said top plate is configured to engage with at least a top of a base plate of said foot pedal;

wherein said one or more receiver nuts are further aligned with said one or more base plate pilot holes and are configured to allow said one or more fasteners to couple said top plate to said base plate of said foot pedal.

4. The system of claim 2, wherein said top surface of said top plate is textured, such that a user's foot is substantially prevented from slipping off said top plate.

5. The system of claim 1, further comprising a first elevation plate;

wherein said first elevation plate is configured to be matingly coupled between said top plate and said base plate of said foot pedal.

6. The system of claim 2, further comprising a first elevation plate;

wherein said first elevation plate is configured to be matingly coupled between said top plate and said base plate of said foot pedal;

wherein said first elevation plate comprises: an elevated portion on a front of said first elevation plate, which comprises one or more tongue holes; two cut tapered side wings; a base portion; one or more base plate holes; and a recessed portion;

wherein said first elevation plate is configured to be coupled between said top plate and said base plate of said foot pedal.

7. The system of claim 6, wherein said elevated portion is configured to matingly engage with said slot opening of said top plate.

8. The system of claim 6, wherein said one or more tongue holes of said first elevation plate are aligned with said one or more tongue pilot holes of said top plate; and wherein said one or more base plate holes of said first elevation plate are aligned with said one or more base plate pilot holes of said top plate.

9. The system of claim 6, wherein said two cut tapered side wings stop short of said front of said first elevation plate and taper inward towards a rear of said first elevation plate.

10. The system of claim 5, further comprising at least one second elevation plate.

11. The system of claim 6, further comprising at least one second elevation plate.

12. The system of claim 11, wherein said at least one second elevation plate is configured to be matingly coupled between said top plate and said base plate of said foot pedal.

13. The system of claim 12, wherein said at least one second elevation plate comprises: one or more tongue holes; two tapered side wings; a base portion; one or more base plate holes; and a recessed portion.

14. The system of claim 13, wherein said one or more tongue holes of said second elevation plate are aligned with said one or more tongue pilot holes of said top plate and said one or more tongue holes of said first elevation plate; and wherein said one or more base plate holes of said second elevation plate are aligned with said one or more base plate pilot holes of said top plate and said one or more base plate holes of said first elevation plate.

15. The system of claim 14, wherein said two tapered side wings of said second elevation plate extend to said front of said second elevation plate and taper inward towards a rear of said second elevation plate.

16. The system of claim 1, further comprising a slot plug, which comprises a peg and one or more tongue holes; and wherein said top plate further comprises a peg slot that is configured to matingly couple with said peg of said slot plug.

17. The system of claim 2, further comprising a slot plug, which comprises a peg and one or more tongue holes; and wherein said top plate further comprises a peg slot that is configured to matingly couple with said peg of said slot plug.

18. The system of claim 2, wherein said power source is a battery that is engaged with said top plate.

19. The system of claim 2, wherein said wiring harness comprises an adapter that is configured to electrically connect said wiring harness to a power source.

20. A replacement heel pedestal system comprising:

a top plate;

a first elevation plate;

a second elevation plate; and a slot plug;

said top plate comprises: a wiring harness; one or more lights; a front that is wider than a rear;

a top portion; a bottom portion; a screw receiving plate that is substantially contained between said bottom portion and said top portion; a top surface; a slot opening; a recessed portion; one or more tongue pilot holes; and one or more base plate pilot holes;

wherein at least said top surface and said top portion of said top plate are transparent;

wherein said wiring harness is configured to connect said one or more lights to a power source, such that when said power source is turned on said one or more lights are illuminated;

wherein said slot opening is a female notch on said front of said top plate that is configured to allow said top plate to couple with a tongue of a foot pedal, such that said top plate and said foot pedal are hingedly coupled together;

wherein said recessed portion is on said bottom and said front of said top plate;

wherein said screw receiving plate comprises one or more receiver nuts that are aligned with said one or more tongue pilot holes and said one or more base plate pilot holes and are configured to allow one or more fasteners to couple said top plate to said tongue of said foot pedal;

wherein said top plate, said first elevation plate, and said second elevation plate are configured to replace an original equipment heel plate and wherein said top plate, second first elevation plate, and said second elevation plate are wider than said original equipment heel plate;

wherein said top portion of said top plate comprises two tapered side wings that extend beyond a width of said bottom portion of said top plate and that taper inward from said front to said rear;

wherein said bottom portion and said top portion of said top plate, said first elevation plate; and said second elevation plate are constructed from styrene-butadiene rubber Shore D-50;

wherein said top surface of said top plate is constructed from styrene-butadiene rubber Shore A-50 and is textured such that a user's foot is substantially prevented from slipping off said top plate;

wherein said first elevation plate comprises: an elevated portion on a front of said first elevation plate, which comprises one or more tongue holes; two cut tapered side wings; a base portion; one or more base plate holes; and a recessed portion;

wherein said elevated portion of said first elevation plate is configured to matingly engage with said slot opening of said top plate;

wherein said two cut tapered side wings stop short of said front of said first elevation plate and taper inward towards a rear of said first elevation plate;

wherein said second elevation plate comprises: one or more tongue holes; two tapered side wings; a base portion; one or more base plate holes; and a recessed portion;

wherein said two tapered side wings of said second elevation plate extend to said front of said second elevation plate and taper inward towards a rear of said second elevation plate;

wherein said slot plug comprises a peg and one or more tongue holes and wherein a peg slot of said top plate is configured to matingly couple with said peg of said slot plug;

wherein a bottom of said top plate is configured to matingly engage with a top of said first elevation plate, wherein a bottom of said first elevation plate is configured to matingly engage with a top of said second elevation plate, wherein a bottom of said second elevation plate is configured to matingly engage with a top of said base plate, such that when said top plate, said first elevation plate, said second elevation plate, and said base plate are engaged and matingly assembled: (1) said one or more tongue pilot holes are aligned with said one or more tongue holes of said first elevation plate and said one or more tongue holes of said second elevation plate; and (2) said one or more base plate pilot holes are aligned with said one or more base plate holes of said first elevation plate and said one or more base plate holes of said second elevation plate.

* * * * *